US006098289A

United States Patent [19]

Wetzel et al.

[11] Patent Number: 6,098,289

[45] **Date of Patent: *Aug. 8, 2000**

[54] DRY-SHAVING APPARATUS

[75] Inventors: Matthias Wetzel, Frankfurt, Germany; Terence G. Royle, Wokingham; Raymond G. Parsonage, Maidenhead, both of United Kingdom

[73] Assignee: Braun Aktiengesellschaft, Germany

[ * ] Notice: Under 35 U.S.C. 154(b), the term of this patent shall be extended for 229 days.

[21] Appl. No.: 08/649,428

[22] Filed: May 16, 1996

Related U.S. Application Data

[62] Division of application No. 08/244,977, filed as application No. PCT/EP92/02960, Dec. 18, 1992, Pat. No. 5,611,145.

[30] Foreign Application Priority Data

Dec. 20, 1991 [GB] United Kingdom ..... 9127092
Dec. 20, 1991 [GB] United Kingdom ..... 9127102

[51] Int. Cl.[7] ..... B26B 19/04
[52] U.S. Cl. ..... 30/43.92; 30/43.9
[58] Field of Search ..... 30/43, 43.9, 43.92

[56] References Cited

U.S. PATENT DOCUMENTS

| | | | |
|---|---|---|---|
| 2,574,317 | 11/1951 | Berg . | |
| 2,629,169 | 2/1953 | Kleinman | 30/43.92 |
| 2,908,074 | 10/1959 | Kleinman . | |
| 3,090,119 | 5/1963 | Jepson | 30/43.92 |
| 3,579,824 | 5/1971 | Matsumoto et al. | 30/43.92 |
| 3,589,005 | 6/1971 | Fischer et al. . | |
| 3,931,675 | 1/1976 | Czerner et al. | 30/43.92 |
| 4,292,737 | 10/1981 | Packham | 30/43.92 |
| 4,797,997 | 1/1989 | Packham et al. | 30/43.92 |
| 4,891,880 | 1/1990 | Poganitsch et al. | 30/43.92 |
| 4,928,389 | 5/1990 | Melwisch et al. | 30/43.92 |
| 4,930,217 | 6/1990 | Wolf et al. | 30/43.92 |
| 4,993,152 | 2/1991 | Deubler | 30/43.92 |
| 5,185,926 | 2/1993 | Locke | 30/43.92 |
| 5,189,792 | 3/1993 | Otsuka et al. | 30/43.92 |
| 5,201,781 | 4/1993 | Jestadt et al. | 30/43.92 |
| 5,383,273 | 1/1995 | Muller et al. | 30/43.92 |
| 5,398,412 | 3/1995 | Tanahashi et al. | 30/43.92 |
| 5,546,659 | 8/1996 | Tanahashi et al. | 30/43.92 |

FOREIGN PATENT DOCUMENTS

| | | |
|---|---|---|
| 0 077 093 | 10/1982 | European Pat. Off. . |
| 0 361 200 | 9/1989 | European Pat. Off. . |
| 63-318985 | 12/1988 | Japan . |
| 950426 | 2/1964 | United Kingdom . |
| WO 91/02629 | 3/1991 | WIPO . |

*Primary Examiner*—Hwei-Siu Payer
*Attorney, Agent, or Firm*—Fish & Neave; Douglas J. Gilbert; Edward S. Podszus

[57] ABSTRACT

Dry-shaving apparatus comprises a drive provided in a housing (1) and at least two parallel shaving units (13, 14, 15), each having a respective outer cutter (16, 17, 20), an inner cutter (21, 22, 34) and at least one biasing element (31, 32, 33, 45). In order to improve contact with the face during use, the biasing element (31, 32) of one shaving unit (13, 14, 15) has a characteristic which differs from that of the biasing element (33) of a further shaving unit (13, 14, 15), which characteristic is such that under the effect or a force applied externally to the shaving units (13, 14, 15), motion can be performed by said one of the shaving units (13, 14, 15) relative to the further shaving unit (13, 14, 15).

21 Claims, 26 Drawing Sheets

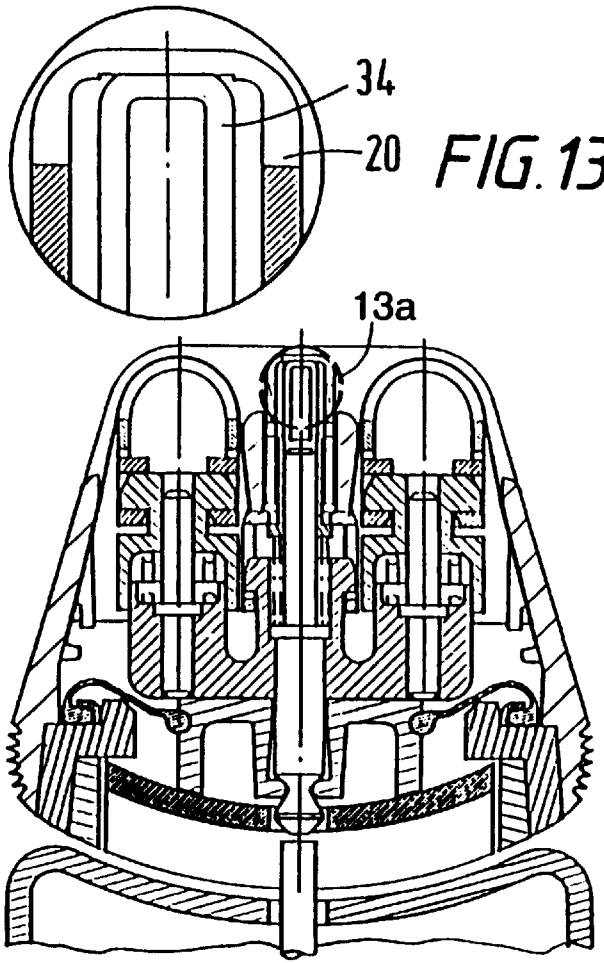
FIG. 13a
FIG. 13
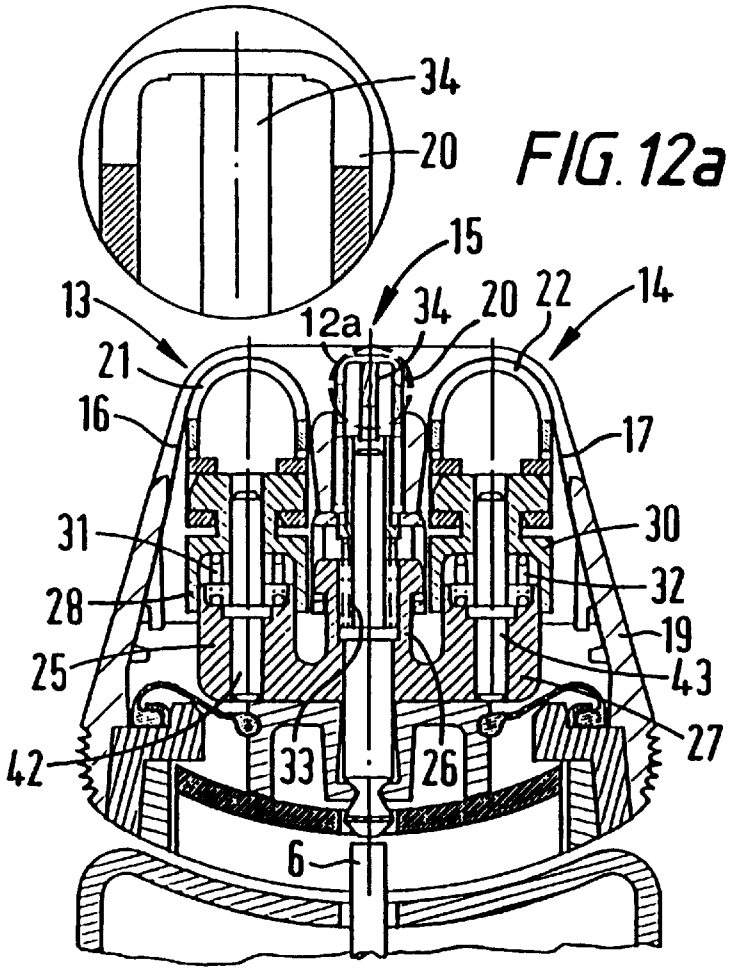
FIG. 12a
FIG. 12

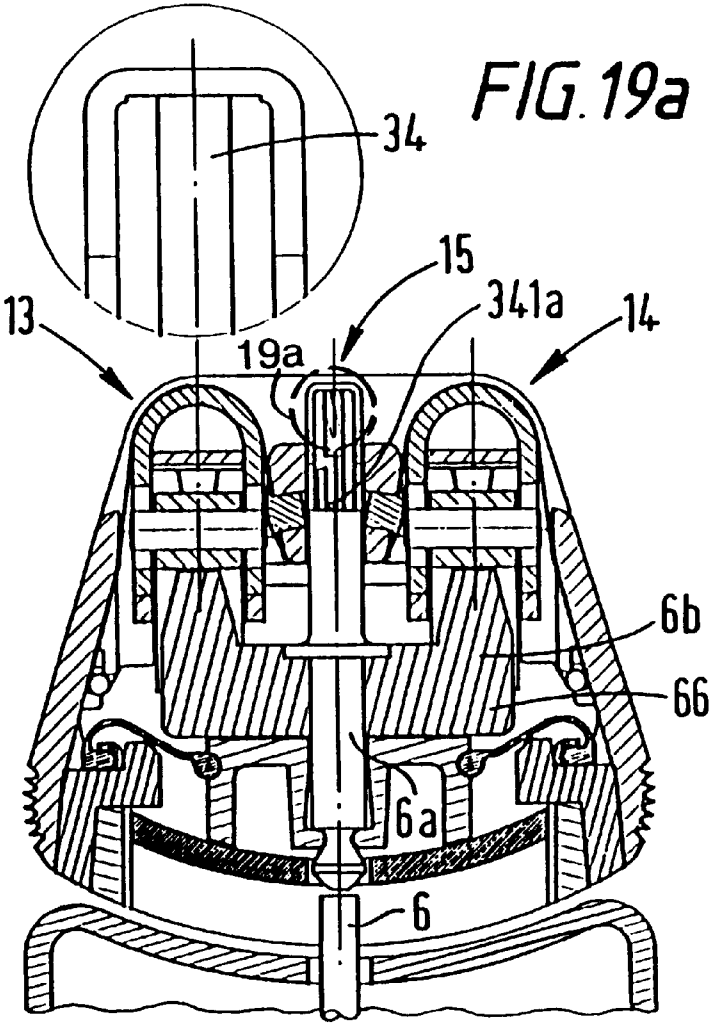
FIG. 19a
FIG. 19
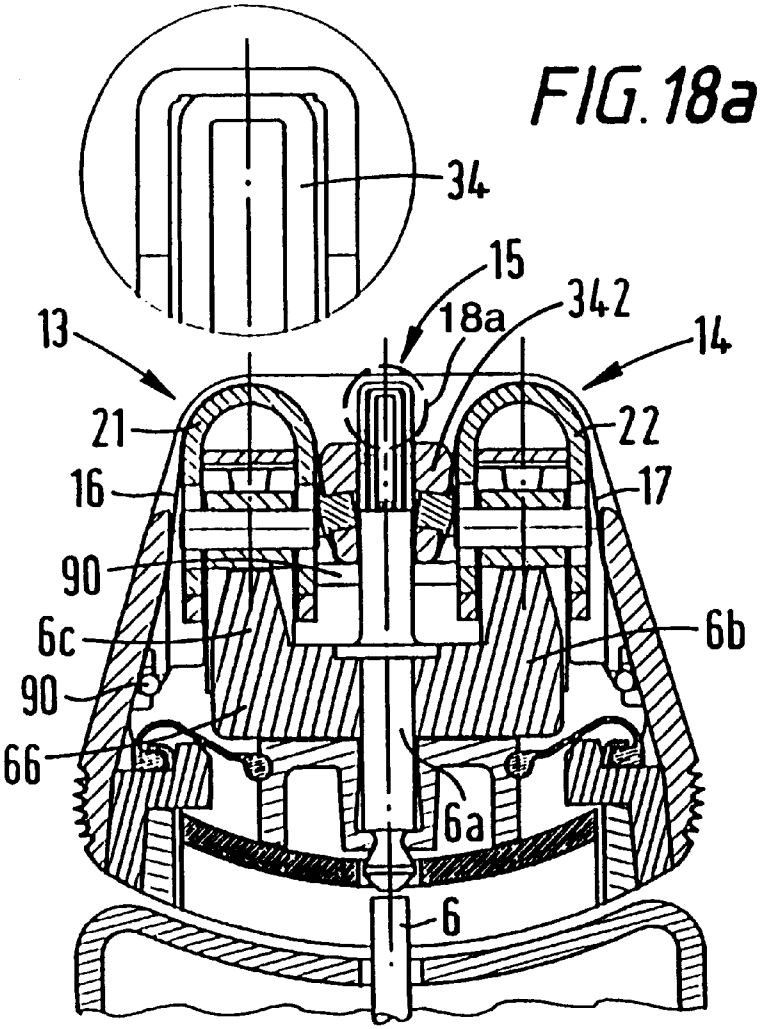
FIG. 18a
FIG. 18

DRY-SHAVING APPARATUS

This is a division of U.S. Ser. No. 08/244,977, filed Nov. 7, 1994, now U.S. Pat. No. 5,611,145 which is a 371 of PCT/EP92/02960, filed Dec. 18, 1992.

The present invention relates to dry-shaving apparatus comprising a drive provided in a housing and at least two parallel shaving unite each consisting or a respective outer cutter, an inner cutter and at least one biasing element.

One example of such dry-shaving apparatus is known from DE-C-3 926 894. In one embodiment each outer cutter is secured on a shaving head frame arranged on the housing. The inner cutters are mounted on a common coupling element which is connected to a drive element of an electrical drive. Each inner cutter is pressed against the associated outer cutter by means of a respective spring element. The two spring elements each have an appropriate characteristic in order to ensure good engagement of the inner cutter with the outer cutter. According to a further embodiment the outer cutter is mounted on a removable frame coupled to the shaving head frame, which is pivotably mounted on the housing of the dry-shaving apparatus.

A dry-shaving apparatus having four parallel shaving units is known from U.S. Pat. No. 3,589,005. The two outer shaving units, constructed as short hair cutters, each consist of an outer cutter, an inner cutter and a spring element arranged between a drive element and the inner cutter. Between the two outer shaving units are provided two comb-like long hair cutters, each of which consists of a toothed cutting comb and an associated toothed cutting blade, particularly for trimming. For this purpose, these toothed long hair trimmers are mounted for adjustment, both together and also independently of one another, relative to the short hair cutters.

Other dry shavers are known from U.S. Pat. No. 4,797,997 and GB-A-2 036 631.

An object of the present invention is to provide a dry-shaving apparatus of the type initially defined in which engagement of the shaving units with the skin to be shaved is improved in a simple manner. Moreover, some embodiments or the invention should permit combination shaving, i.e. simultaneous cutting of long and short hairs.

According to one aspect of the invention, apparatus of the type initially defined is characterised in that the biasing element of one of the having units has a characteristic which differs from that of the biasing element of a further or the shaving units and is dimensioned such that under the influence of externally applied force onto the shaving units movement may be-performed by said one of the shaving units relative to the further shaving unit.

According to a further aspect of the invention, there is provided dry-shaving apparatus of the type initially defined characterised in that each cutter and associated biasing element are mounted within the associated shaving unit to be removable are a part of the shaving unit.

According to another aspect of the present invention, there is provided dry-shaving apparatus comprising: a shaver body; a removable shaver head comprising at least two intercoupled shaving unite each having an open-bottomed arched shaving foil mounted for movement relative to the shaver body; an inner cutter inside the arch of each roil and mounted for reciprocatory movement along the axis of the foil while subject to a biasing force which maintains the inner cutter pressed into contact with the foil to achieve a shaving action on the foil; a biasing element for each cutter to provide the biasing force; and drive means to provide the reciprocatory movement while accommodating movements of each cutter transverse to the direction of the reciprocatory movement, characterised in that: each cutter and associated biasing element are mounted within the associated shaving unit to be removable as a part of the shaver head.

In one embodiment, each biasing element acts between the associated cutter and a support on the associated shaving unit.

Conveniently, the drive means comprises a pin which locates within a slot in the driven cutter, the slot being elongate In the transverse direction of the cutter to permit relative transverse movement of the drive pin and cutter, so that the drive pin need not follow the transverse movements of the foil, but the cutter can faithfully follow these transverse foil movements. A pin with a bifurcated head, for example, a T-bar head, with one limb or the pin in the transverse slot of a cutter of a twin head shaver, is a particularly attractive possibility. These pin or T-bar drives occupy very little space and so offer good possibilities for a closer approach to debris transparency.

For better understanding of the invention, and to show more clearly how the same may be carried into effect, reference will now be made, by way of example, to the accompany drawings, in which.

Figure 1:
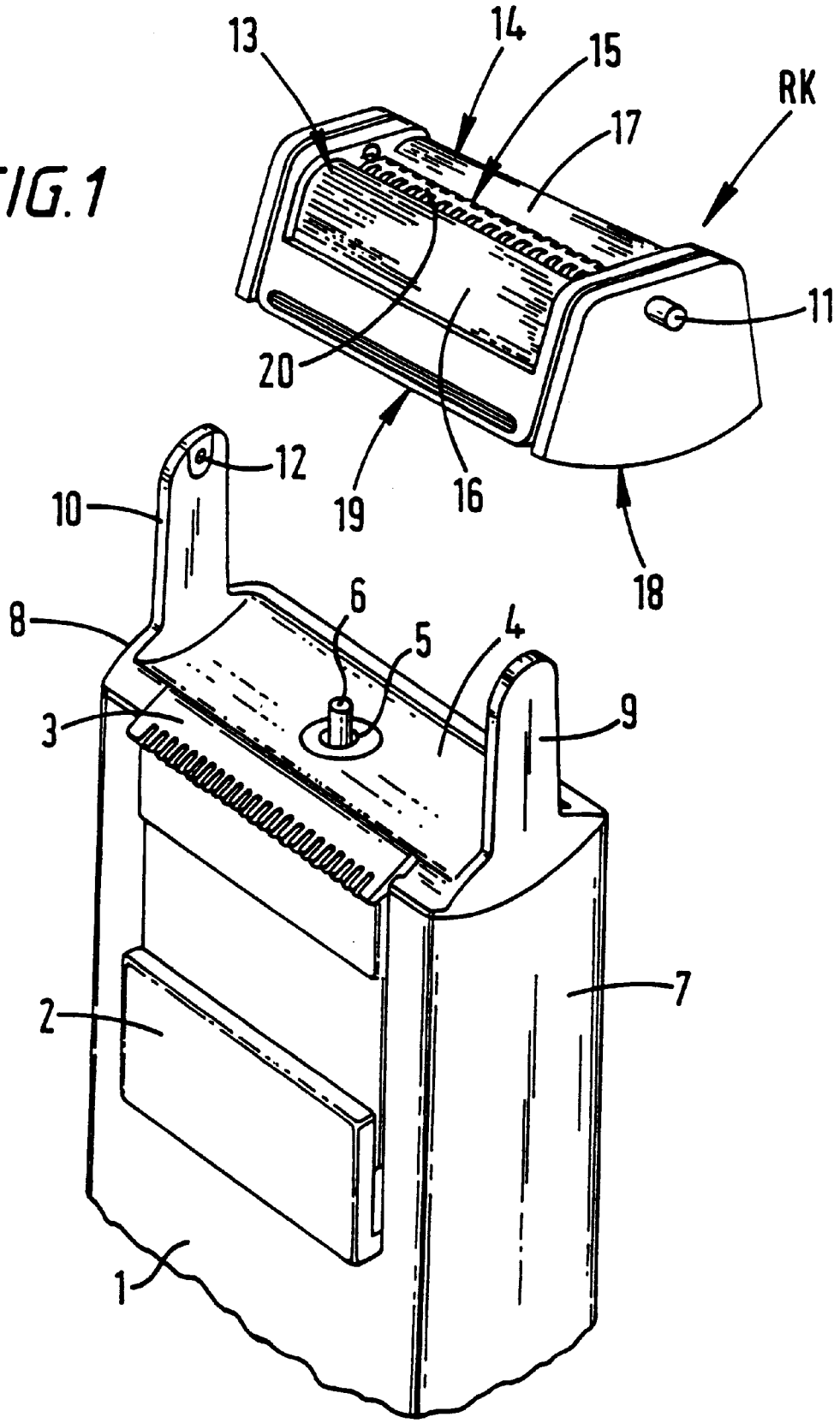
FIG. 1 is a perspective view, partially disassembled and partially broken away, of dry-shaving apparatus according to a first embodiment of the invention.
Figure 2:
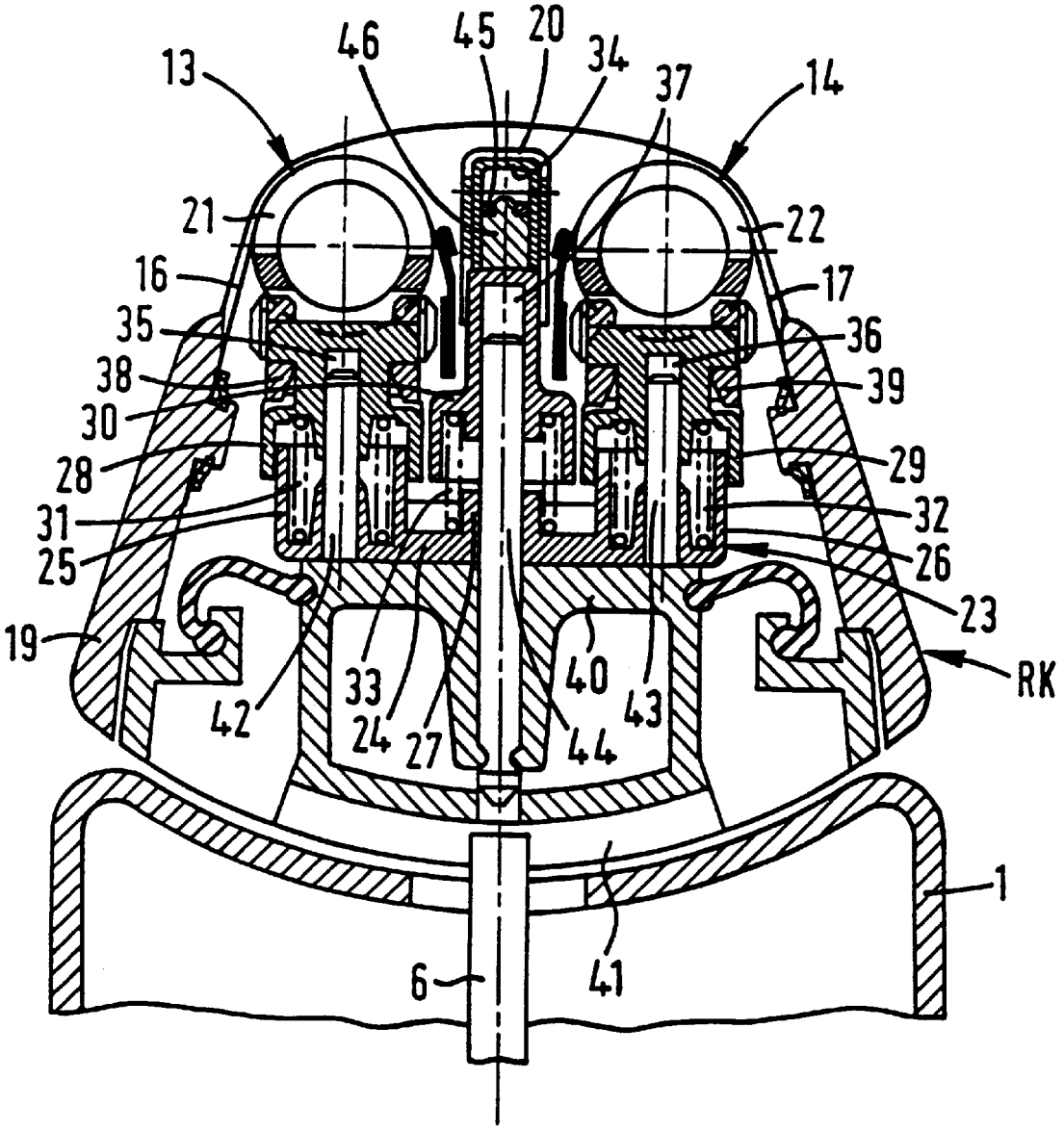
FIG. 2 is a cross-sectional view taken through the shaving head of the apparatus of FIG. 1, in a plane perpendicular to the line X—X.
Figure 3:
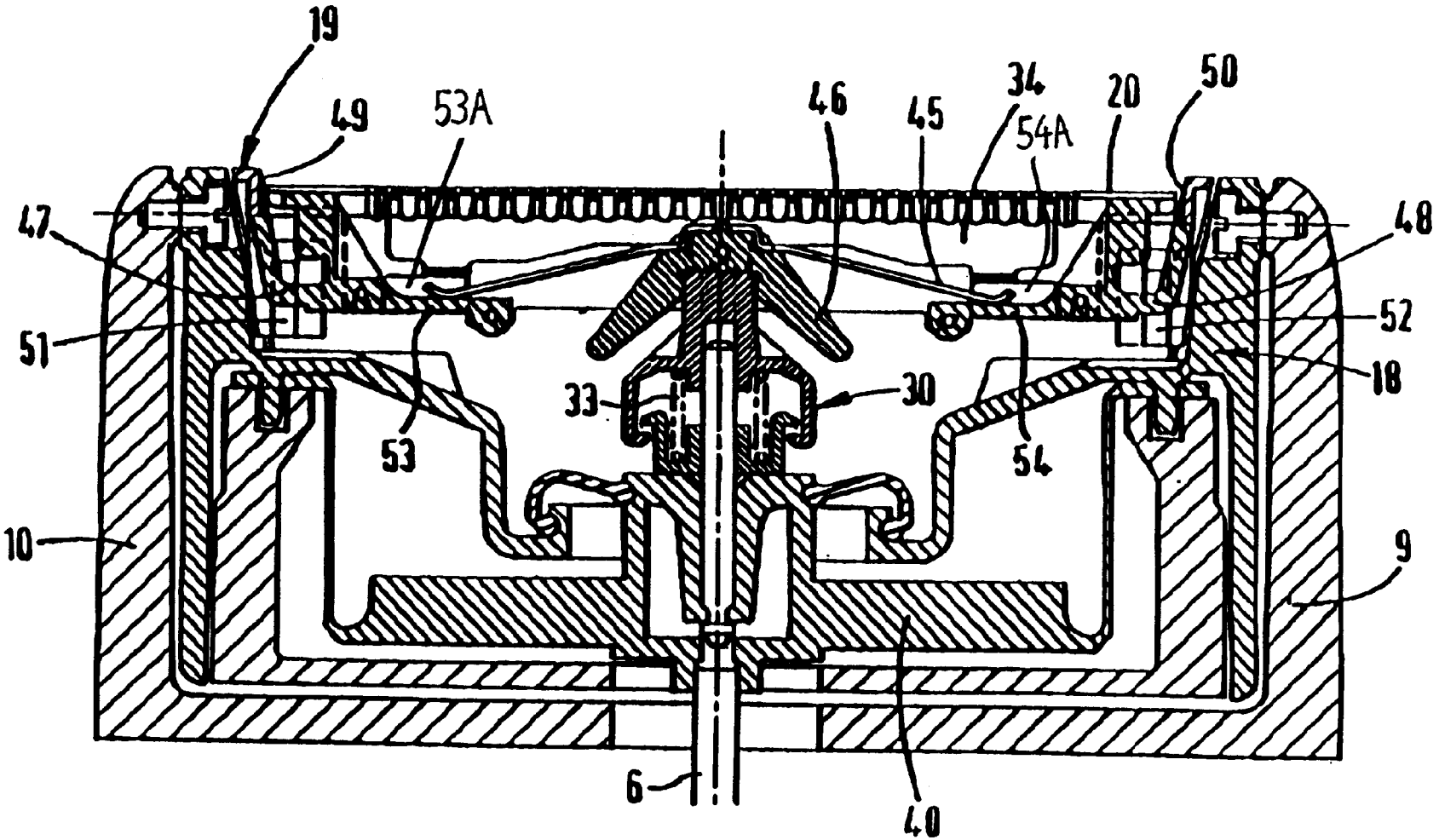
FIG. 3 is a longitudinal sectional view through the shaving head of the apparatus of FIG. 1 in a plane containing the line X—X.
Figure 3A:
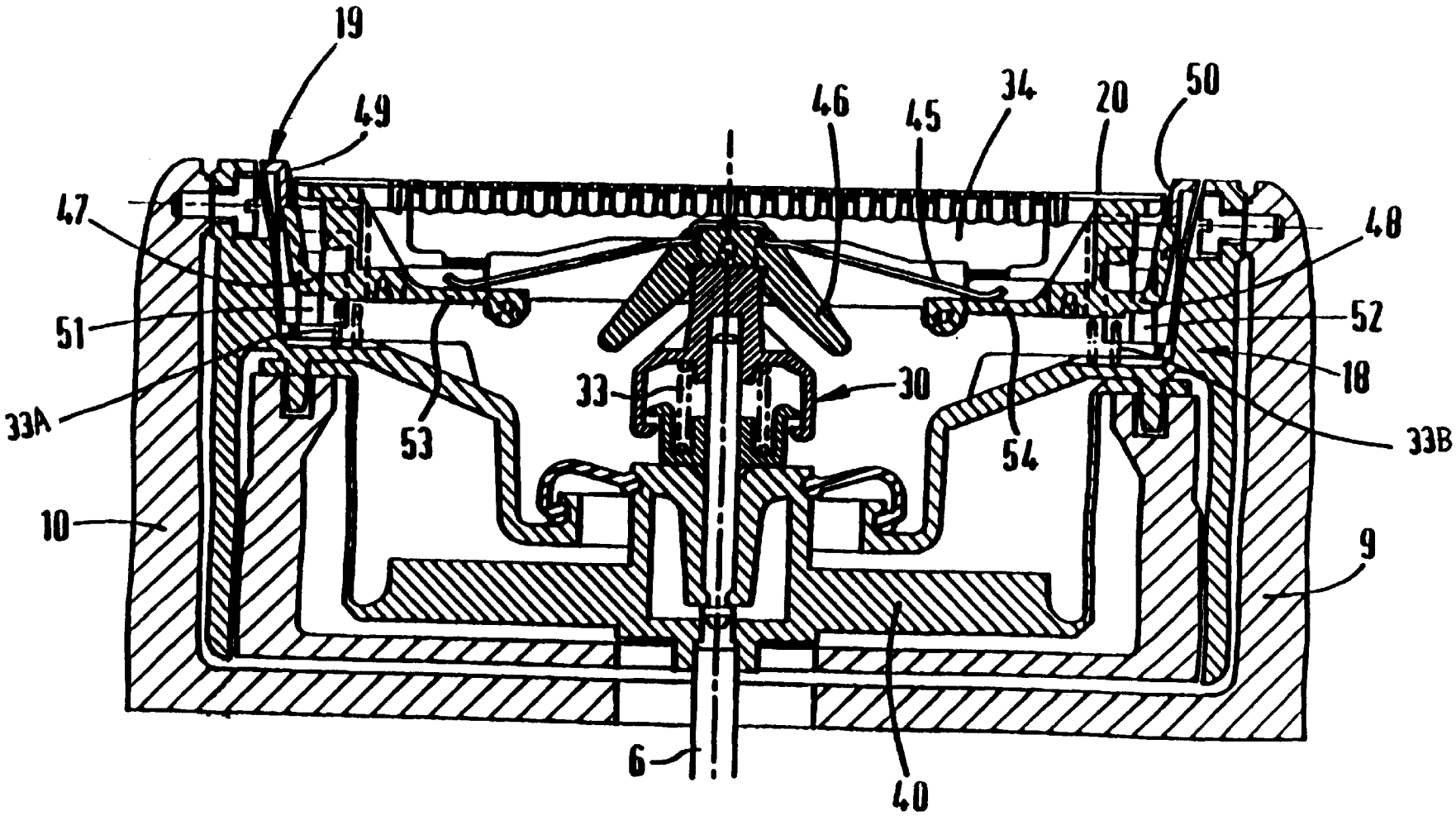
Figure 4:
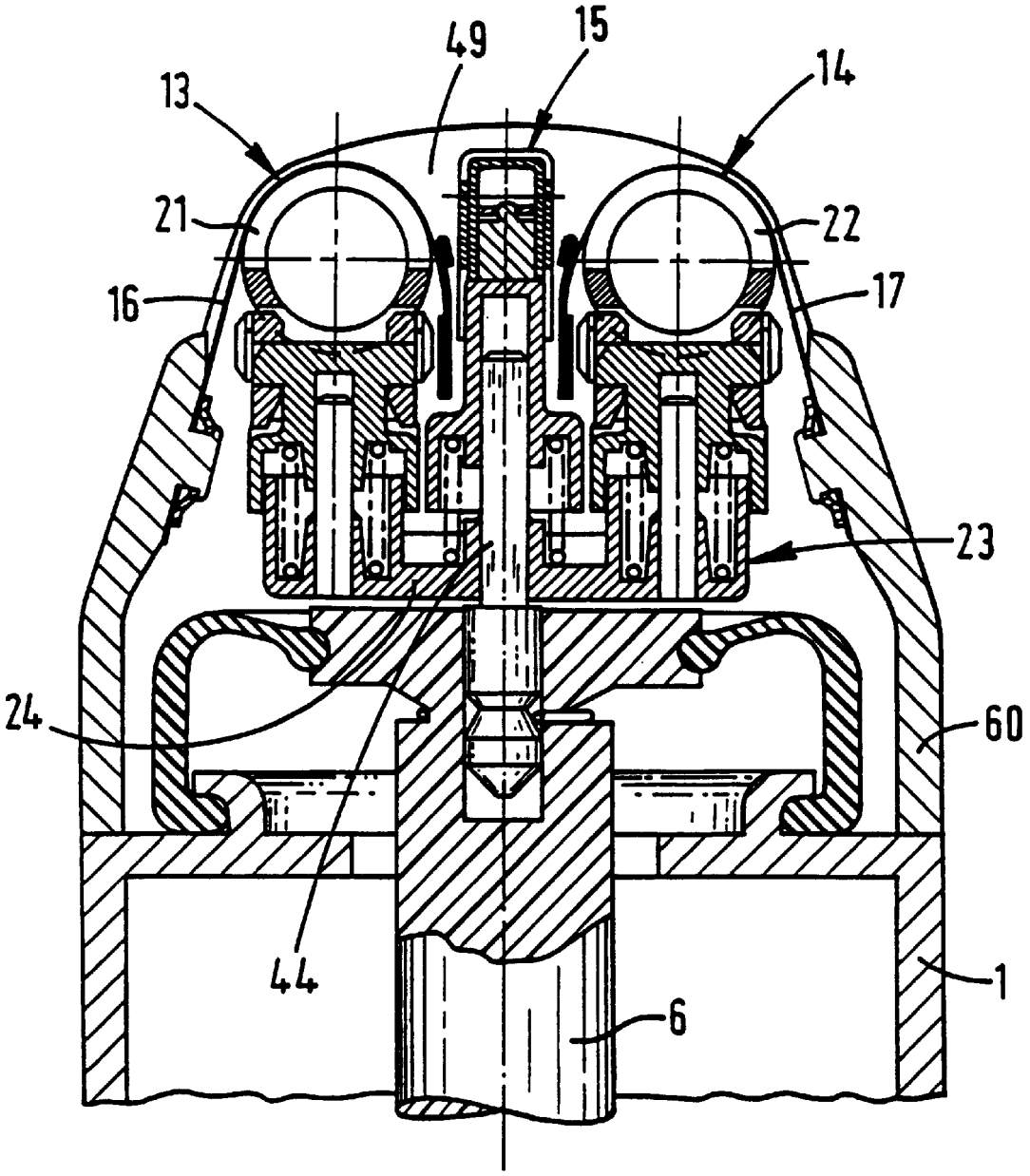
Figure 6:
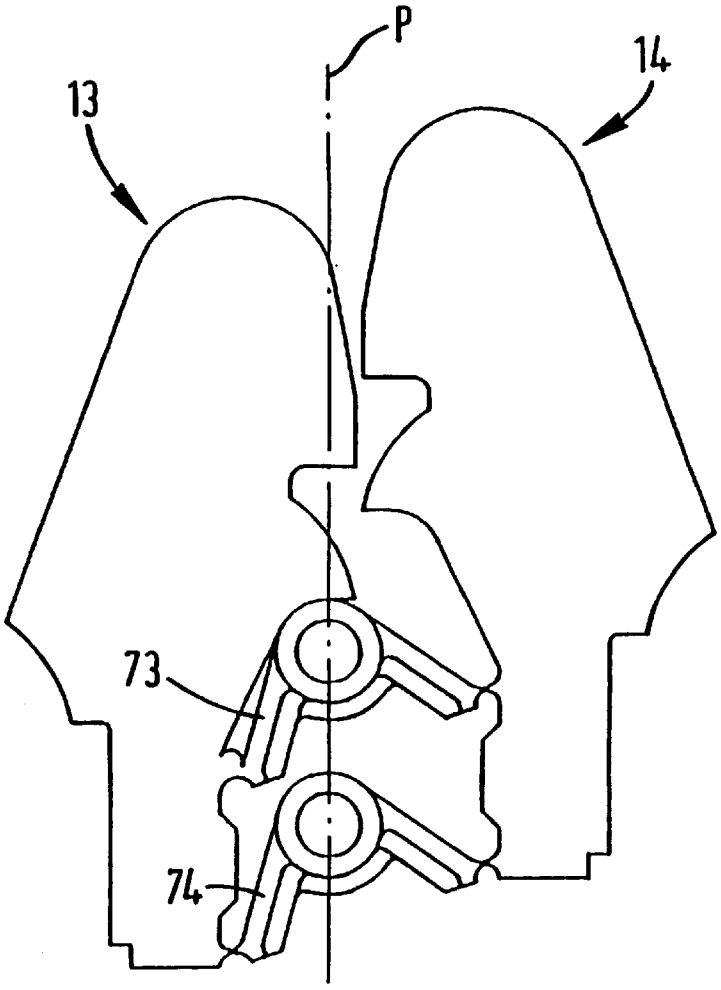
Figure 5:
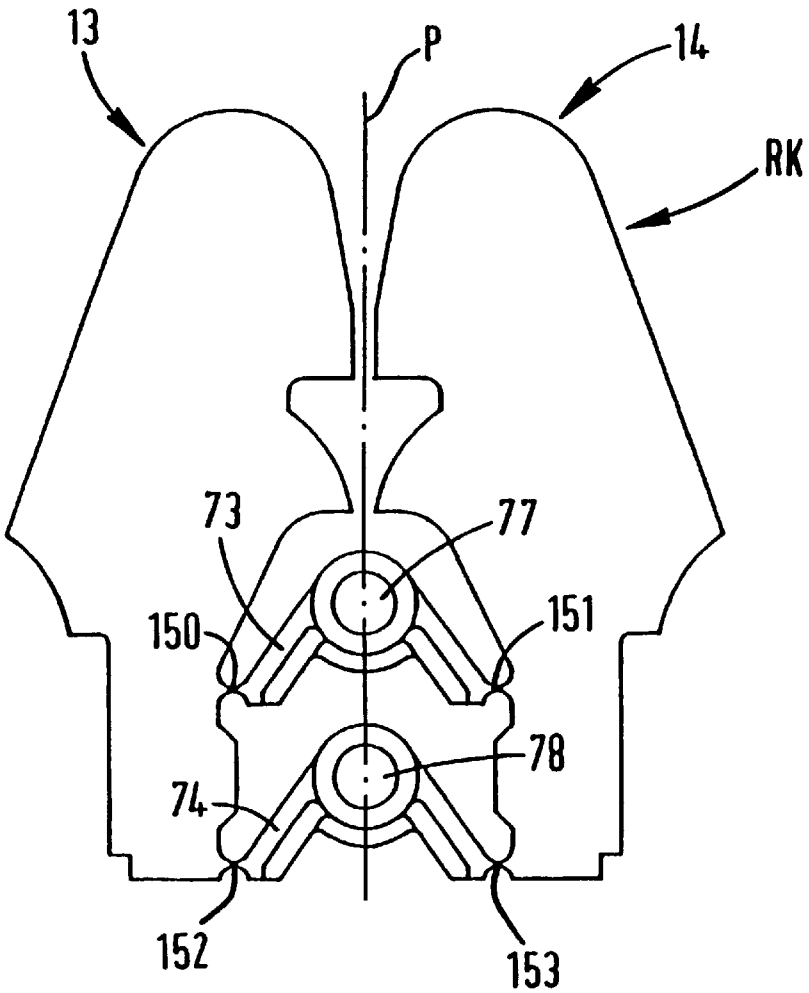
Figure 7:
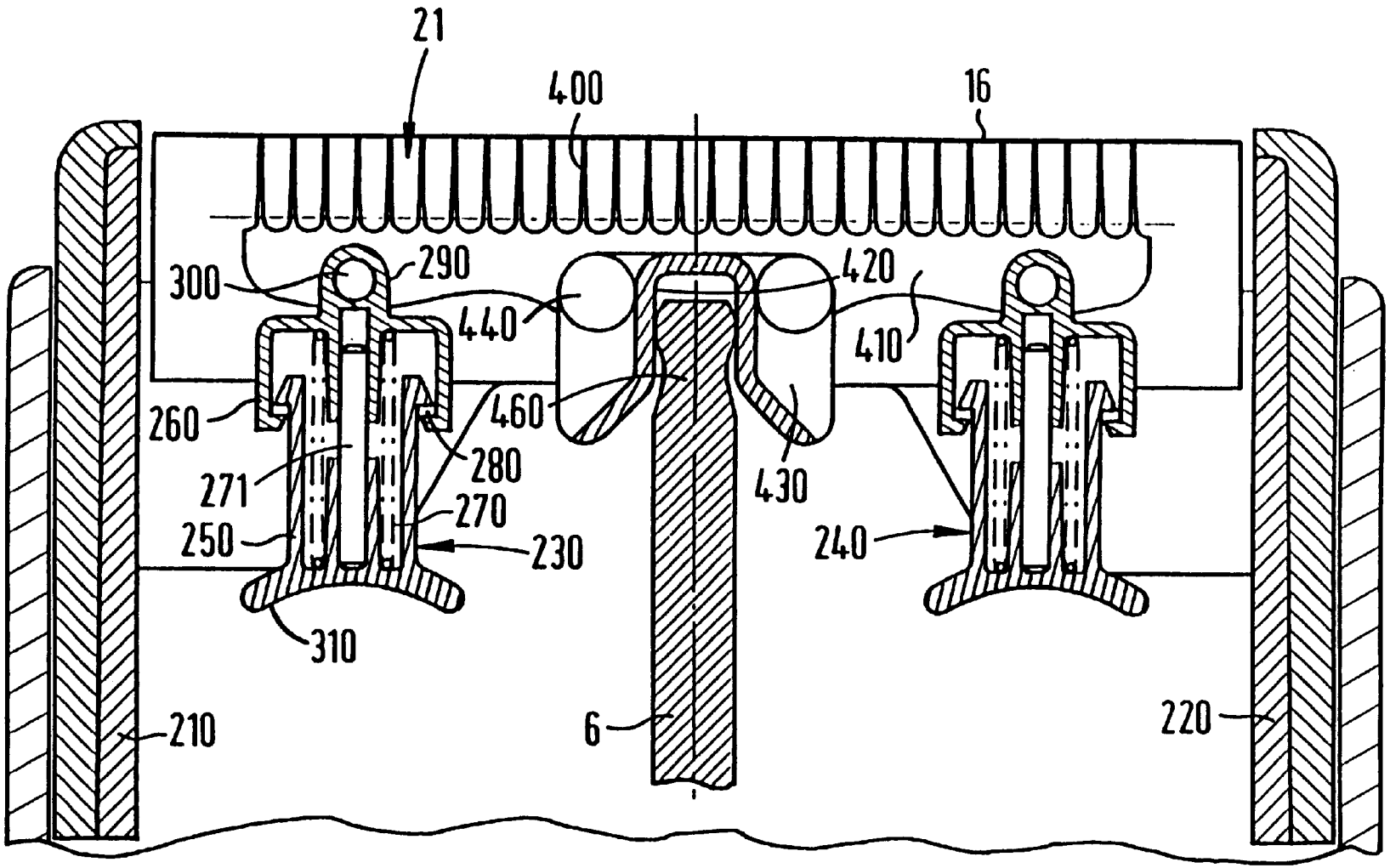
Figure 8:
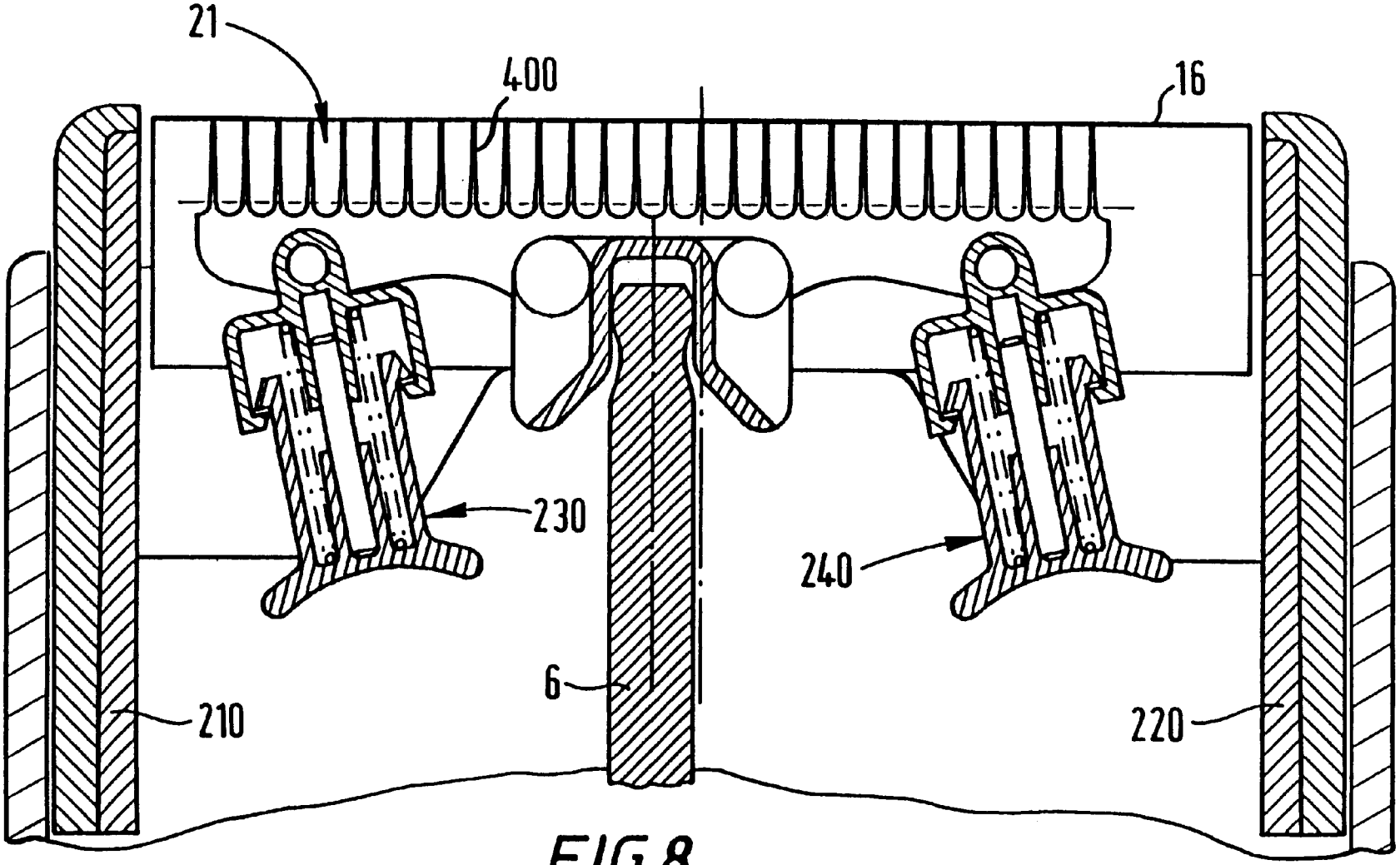
Figure 9A:
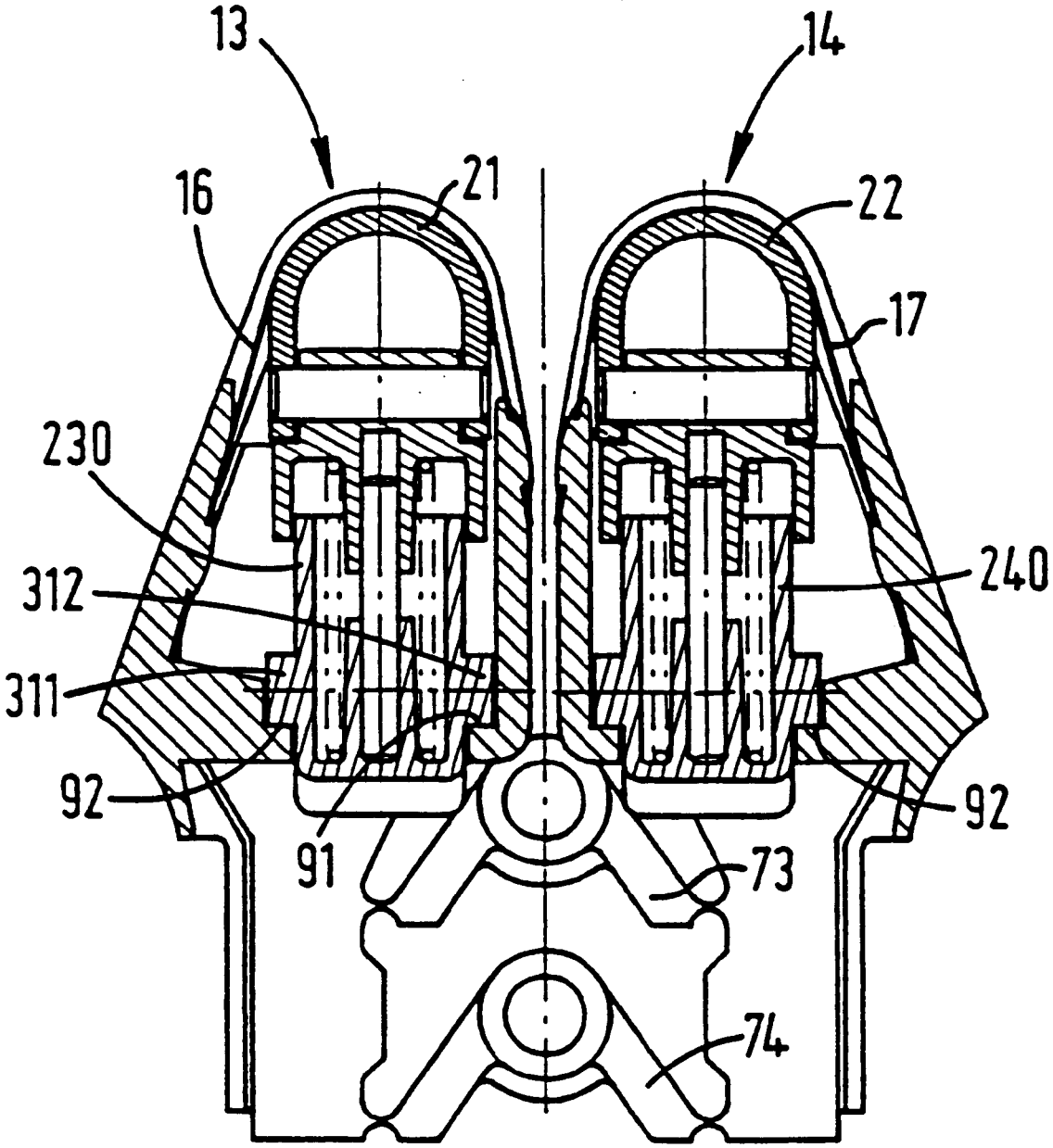
Figure 9B:
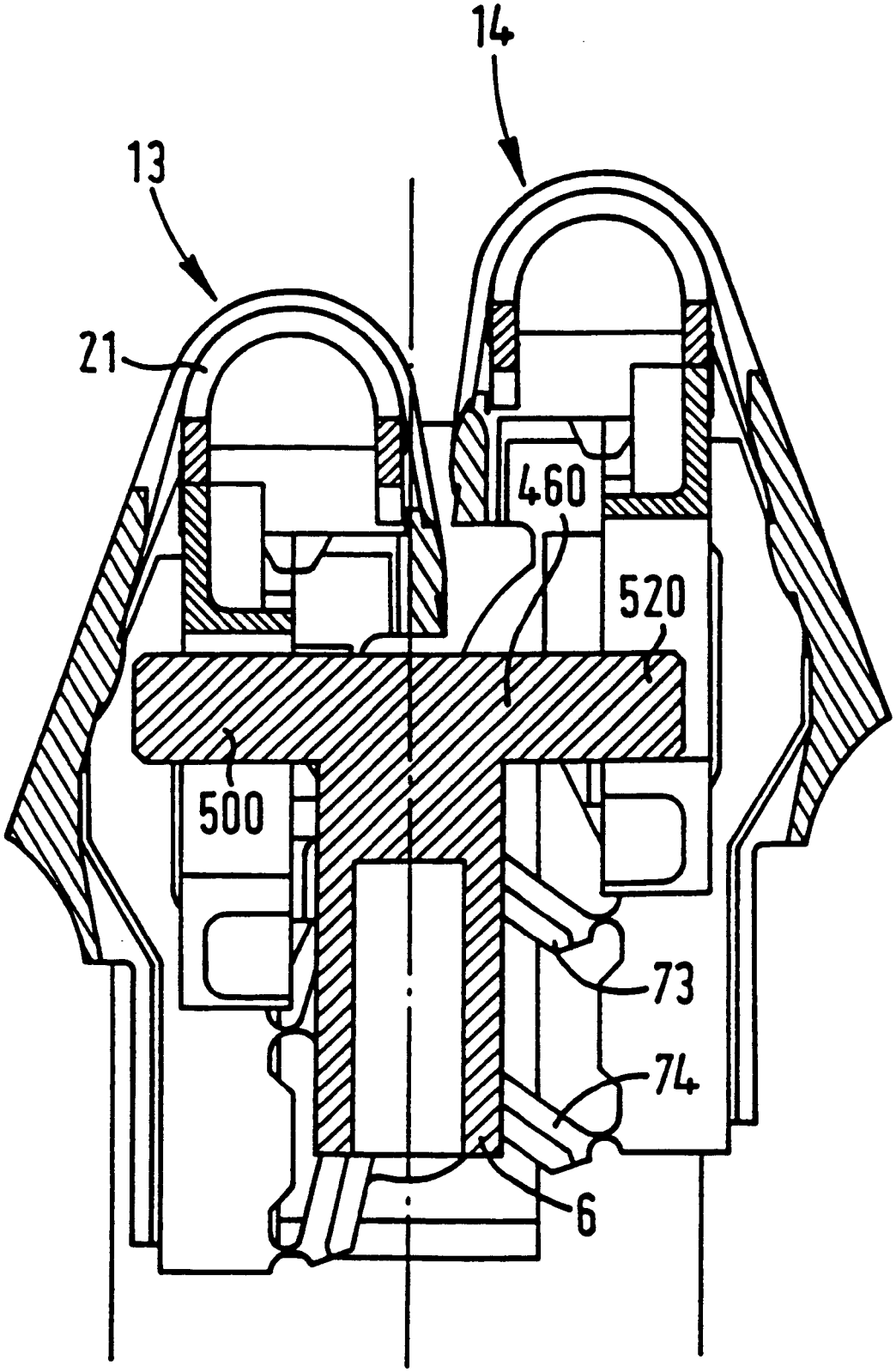
Figure 10:
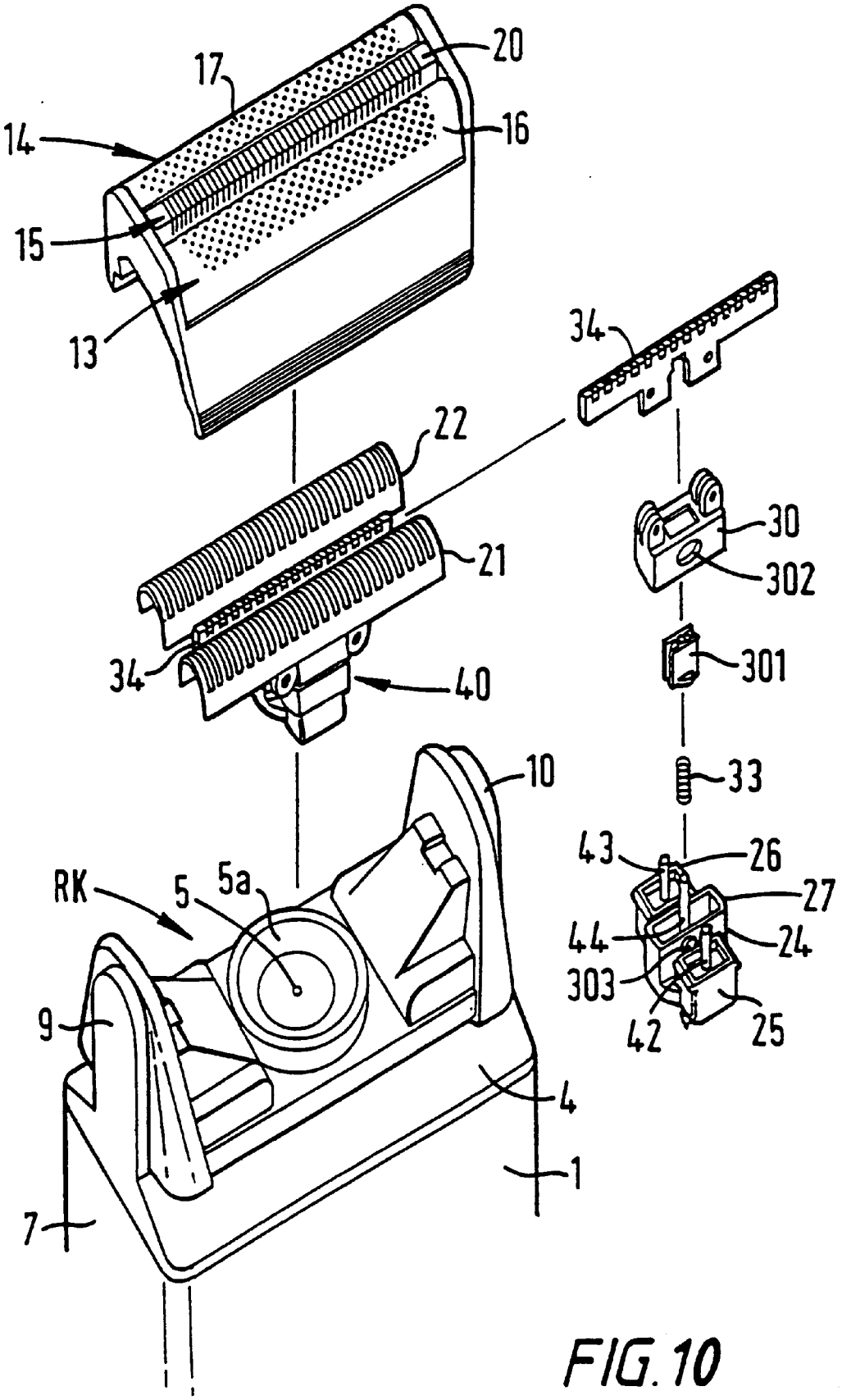
Figure 11:
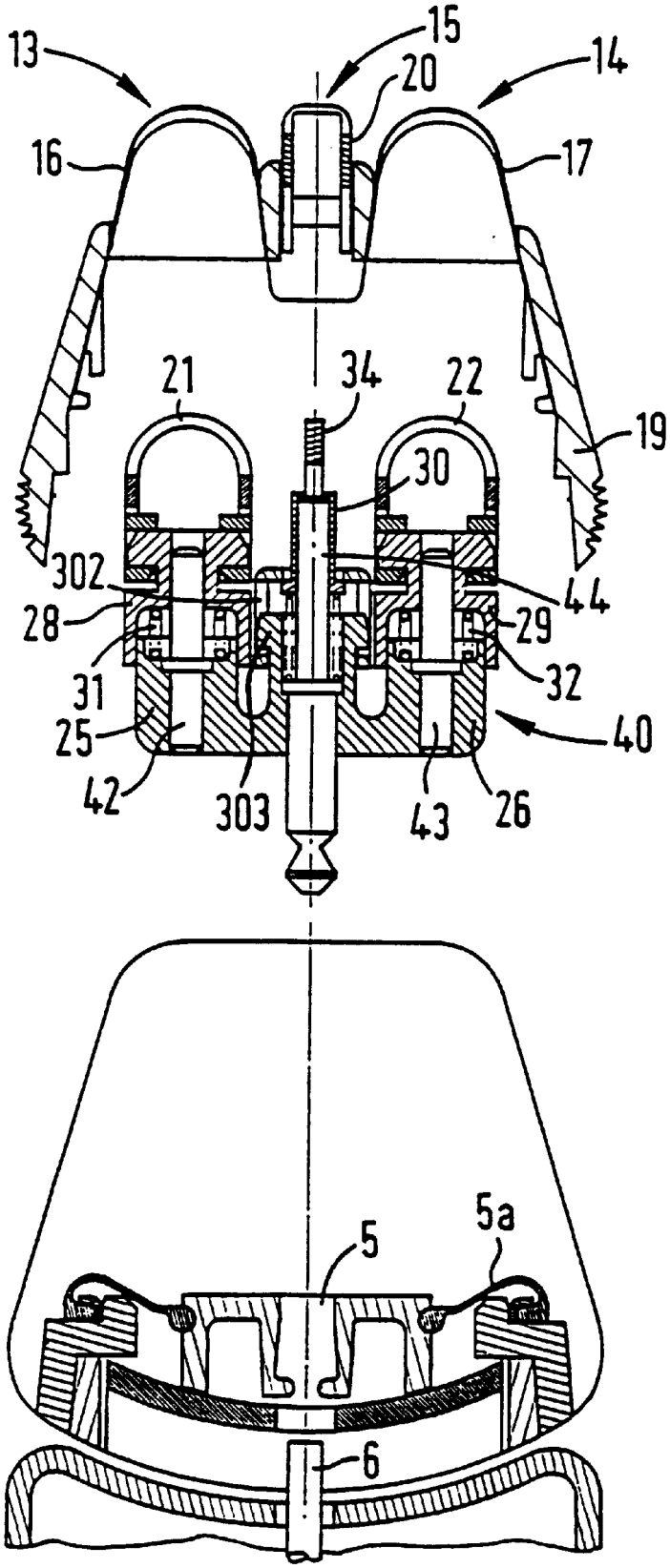
Figure 14A:
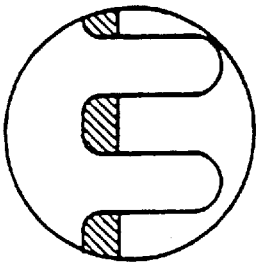
Figure 14:
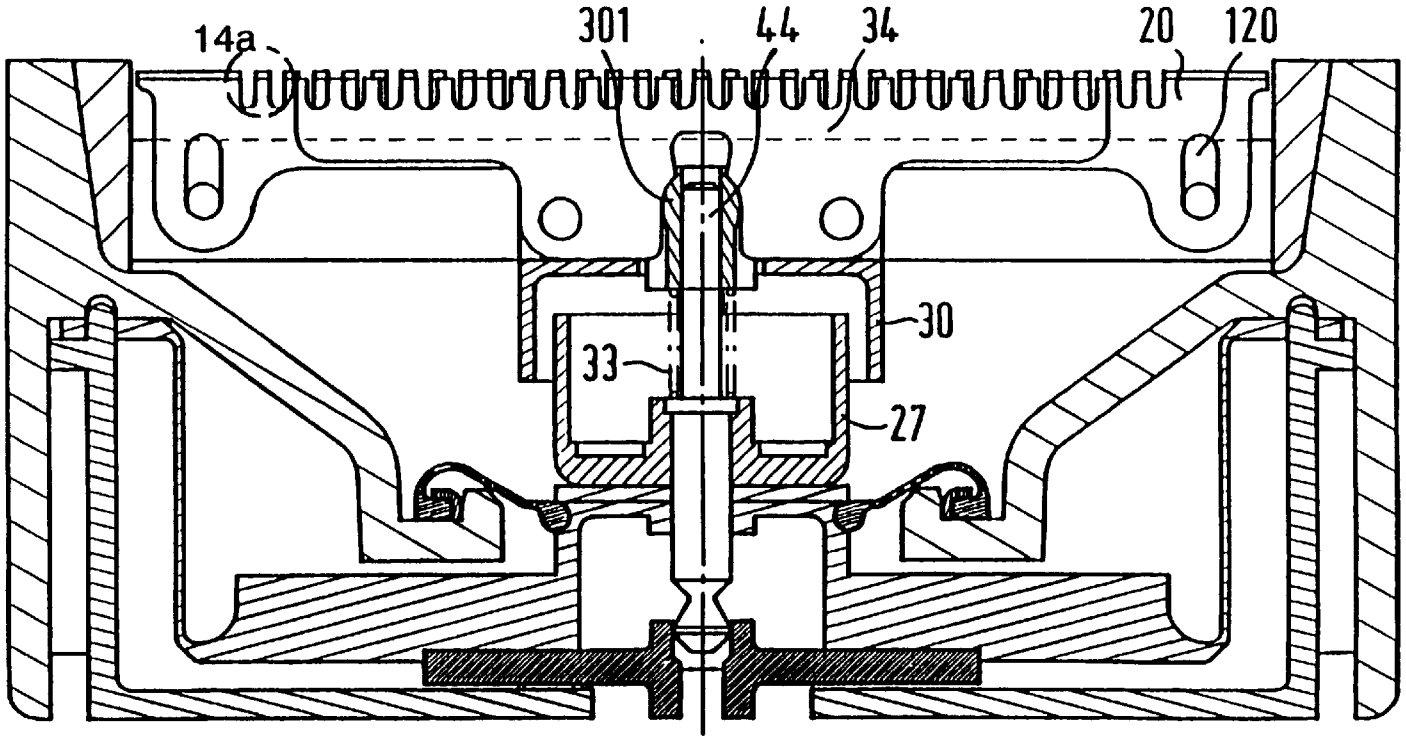
Figure 15:
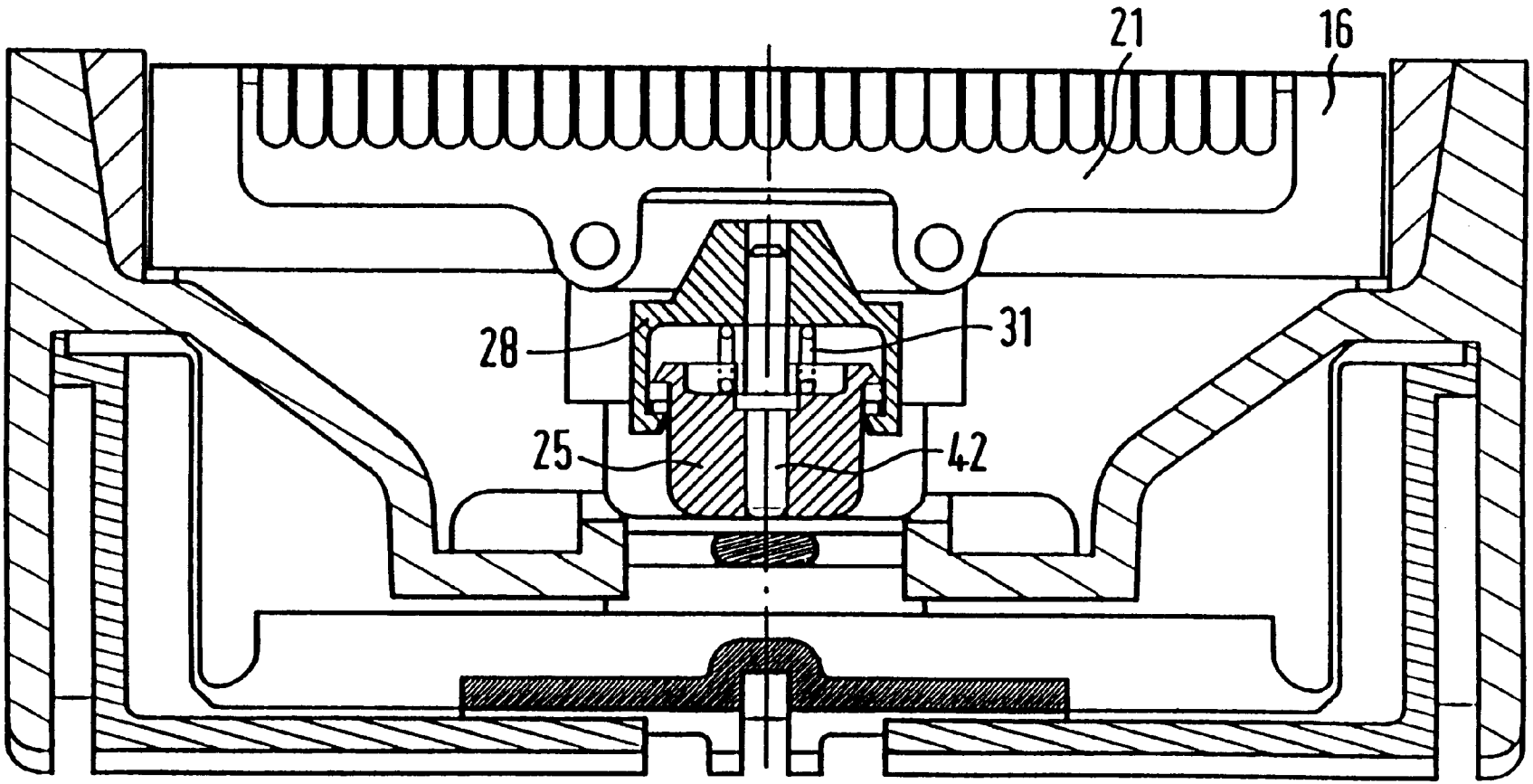
Figure 16A:
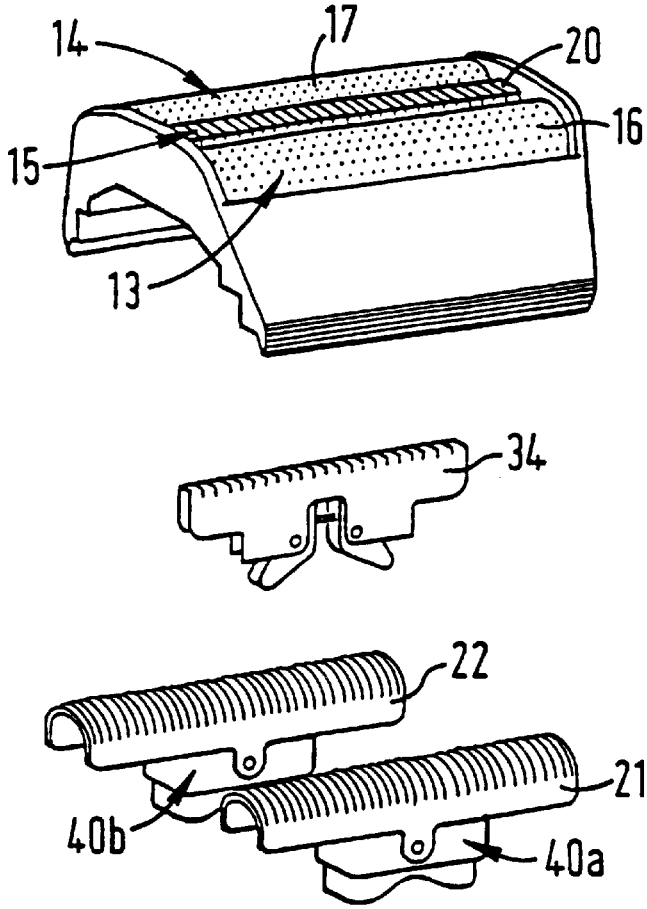
Figure 16A:
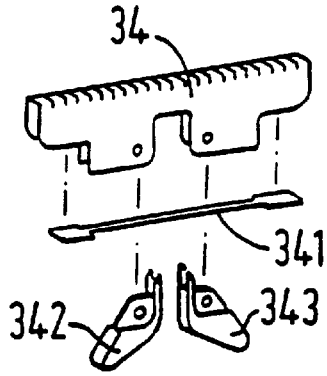
Figure 16:
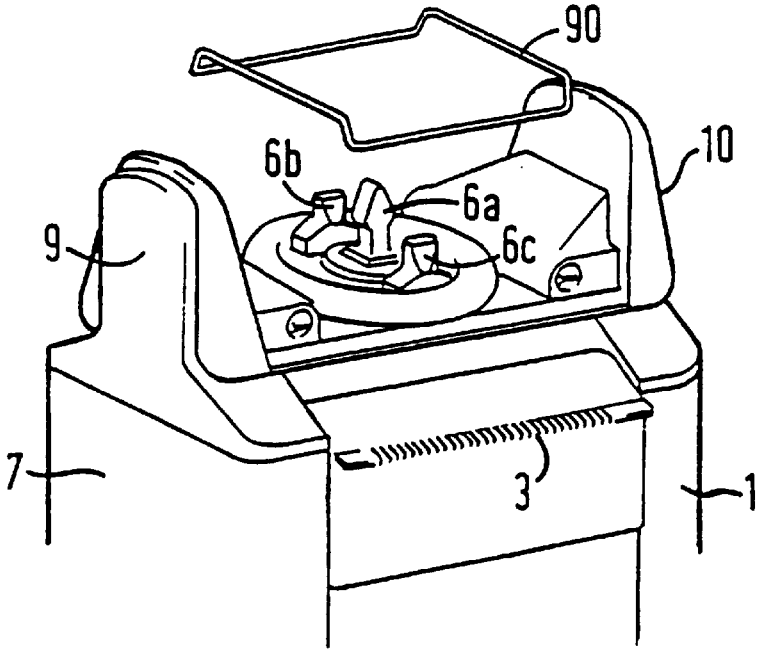
Figure 17:
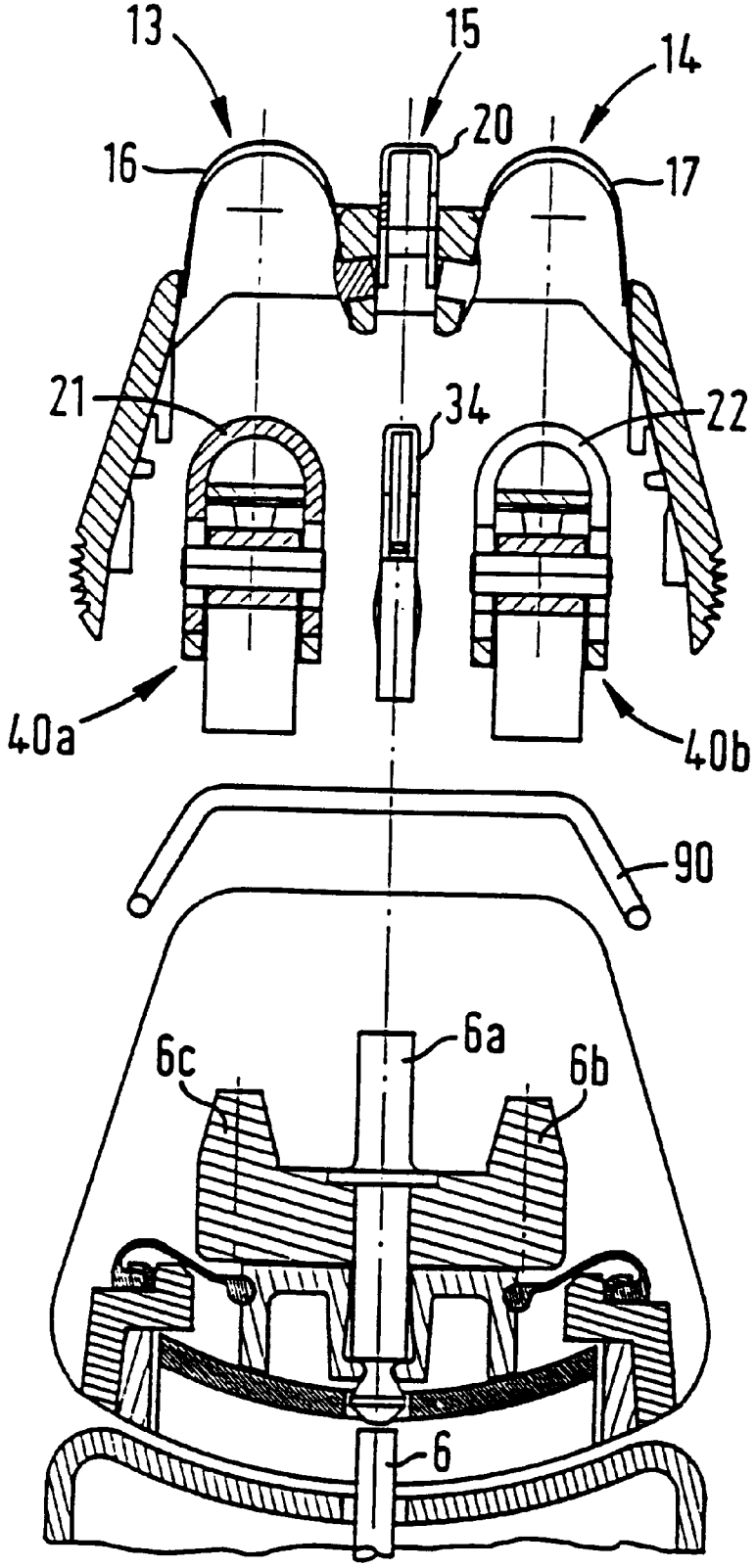
Figure 20:
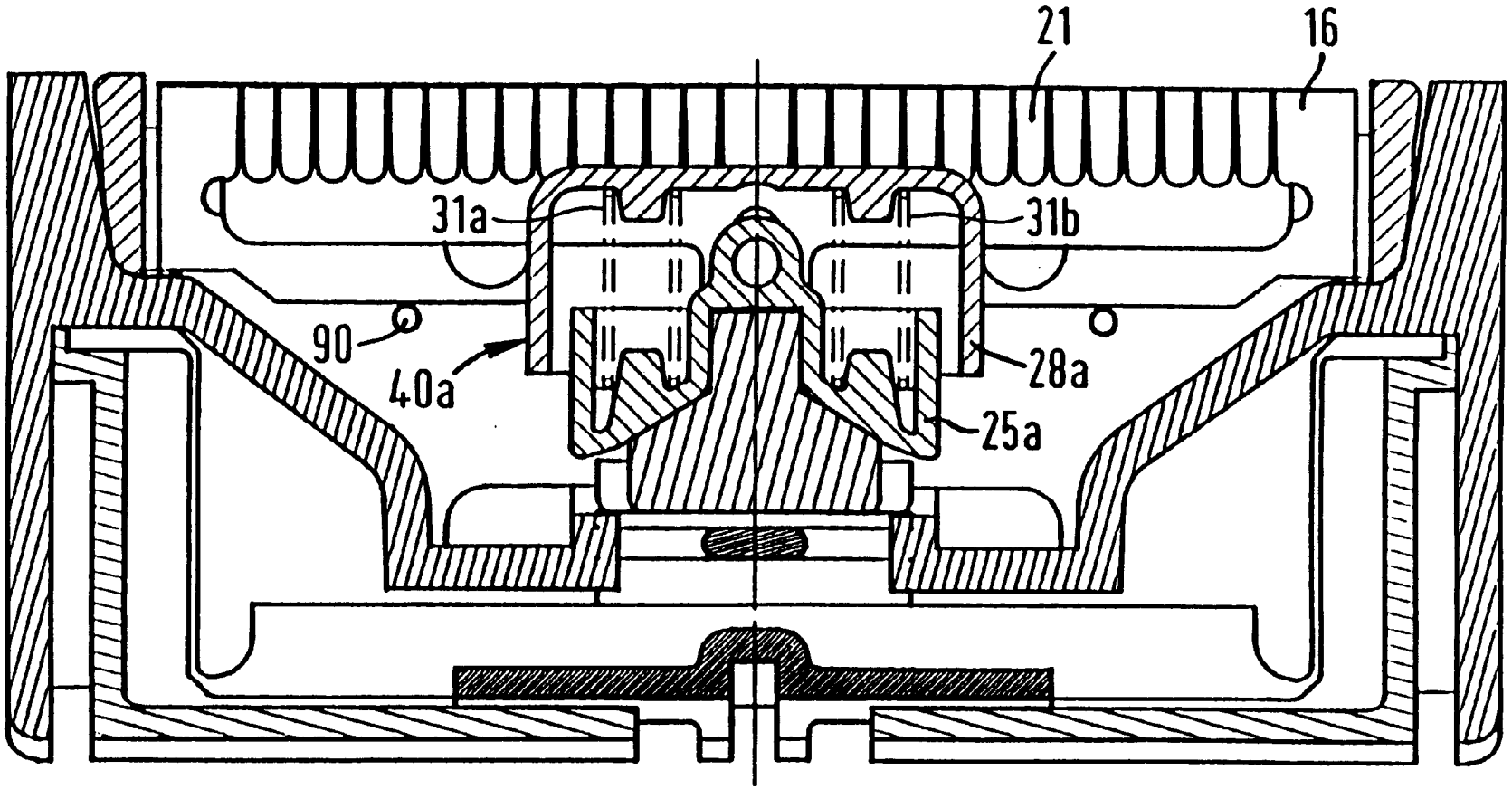
Figure 21:
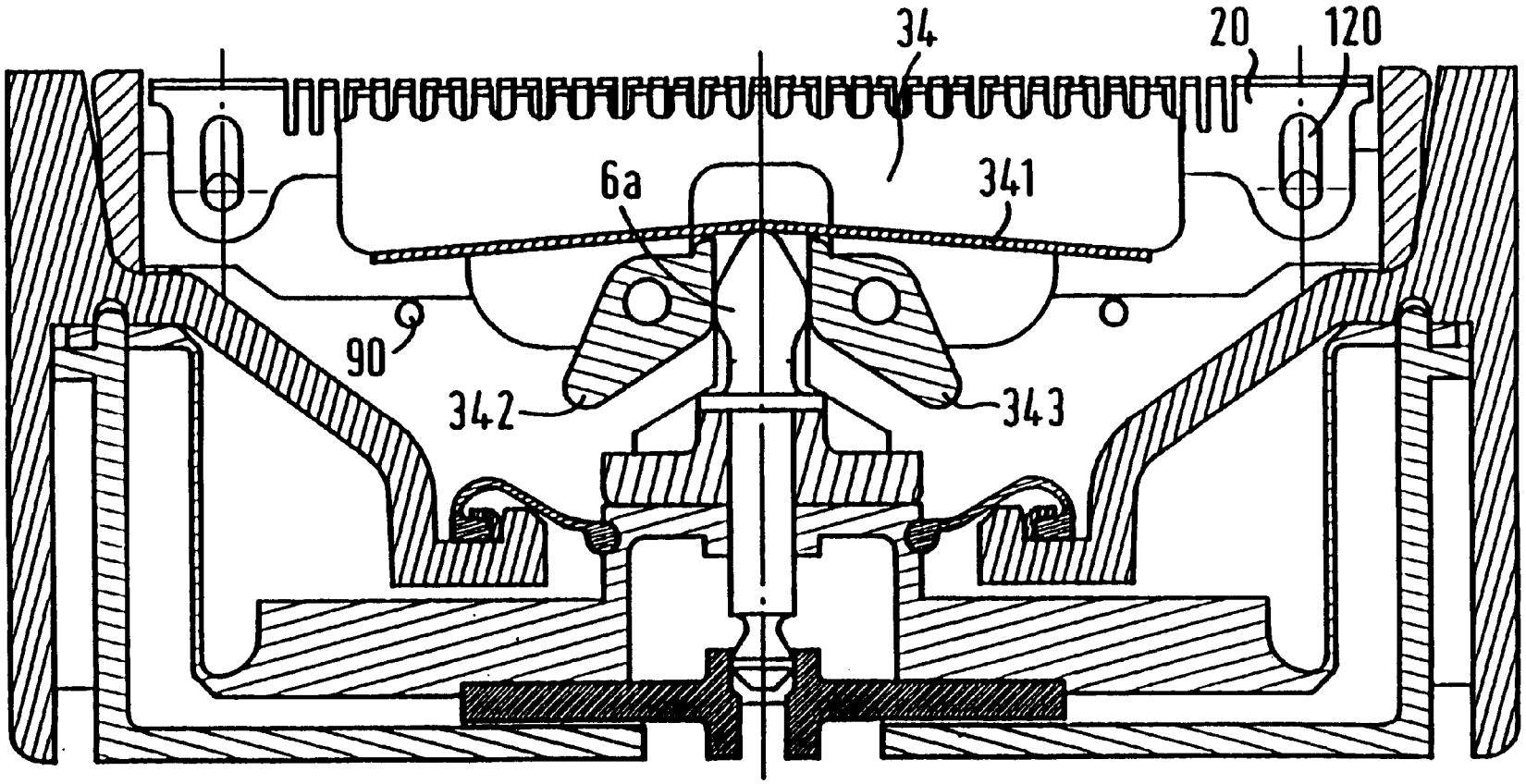
Figure 22:
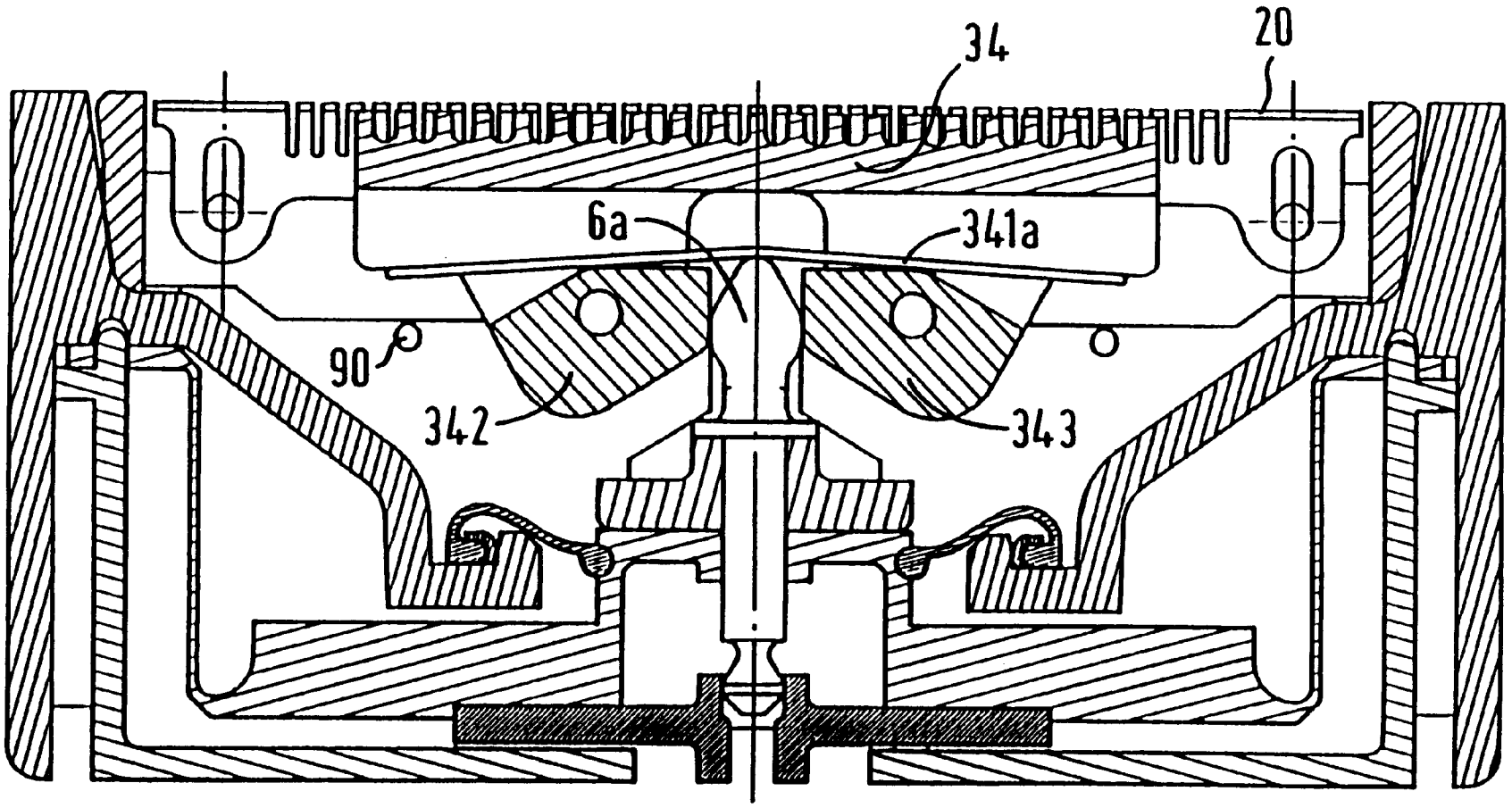
Figure 23:
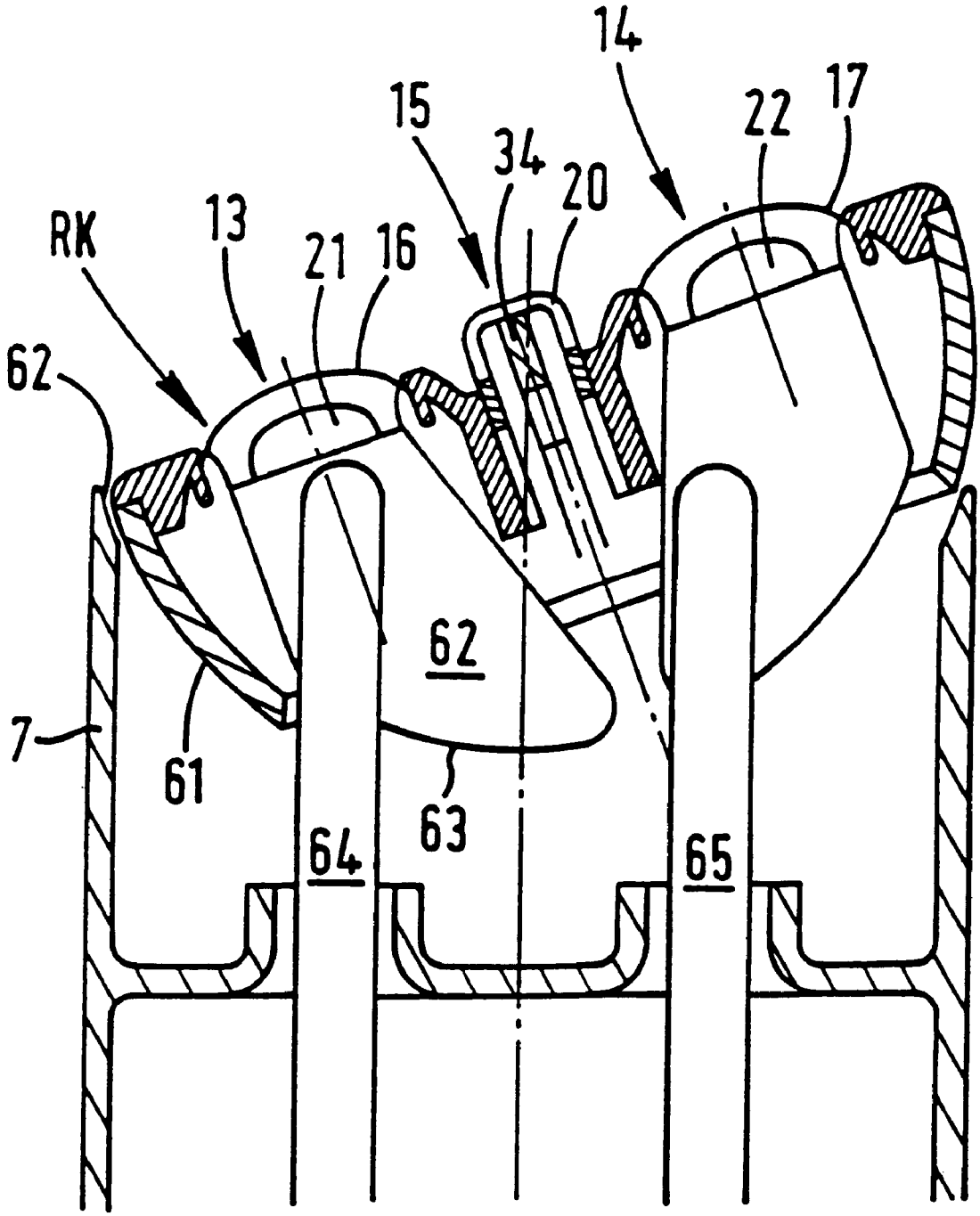
Figure 24:
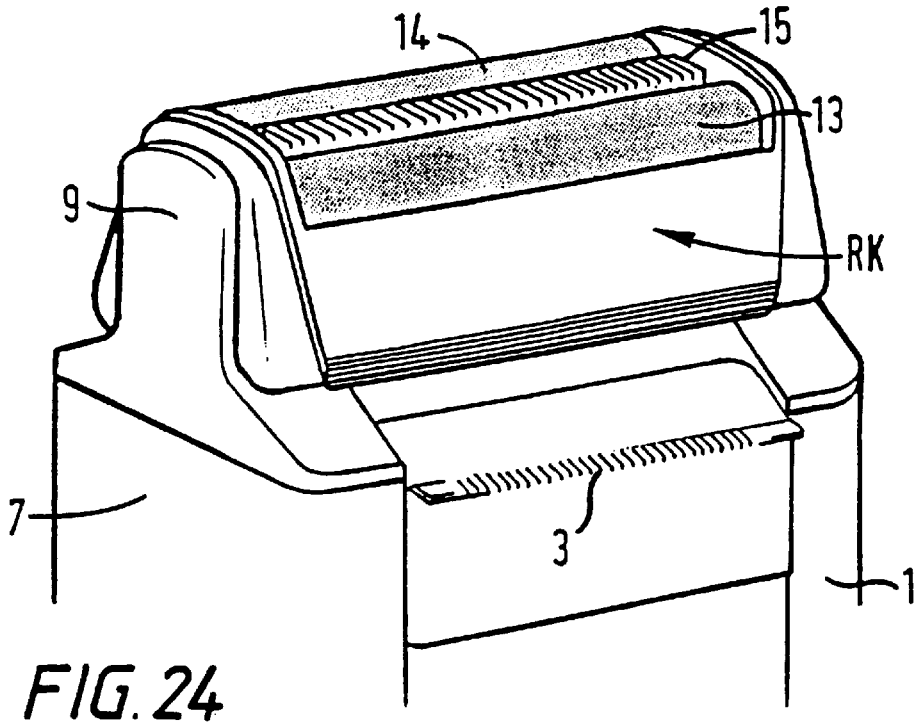
Figure 25:
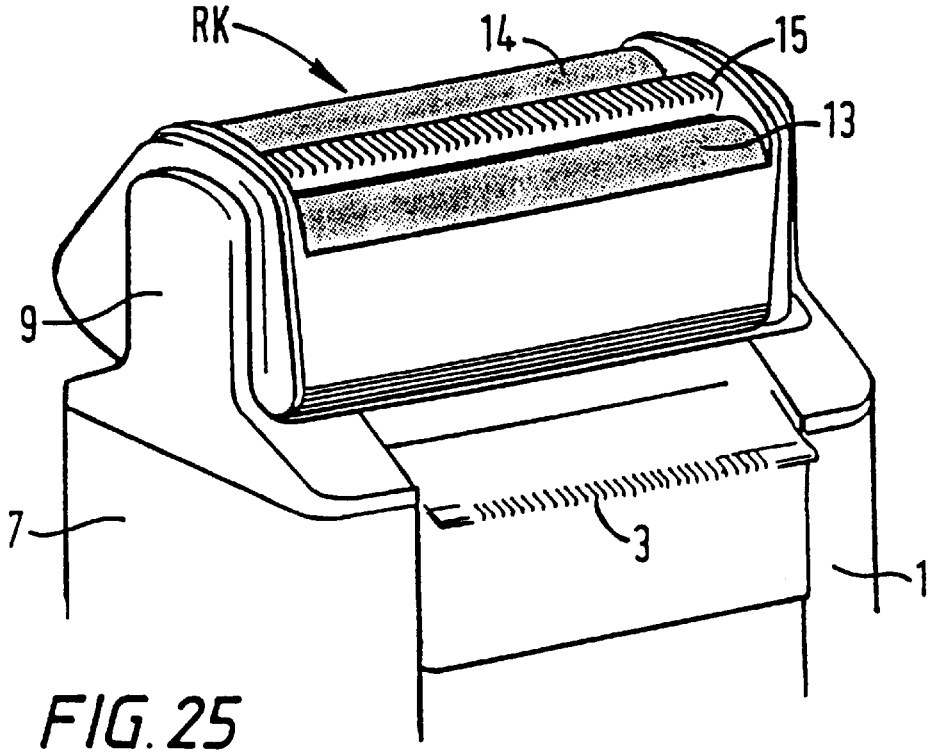
Figure 26C:
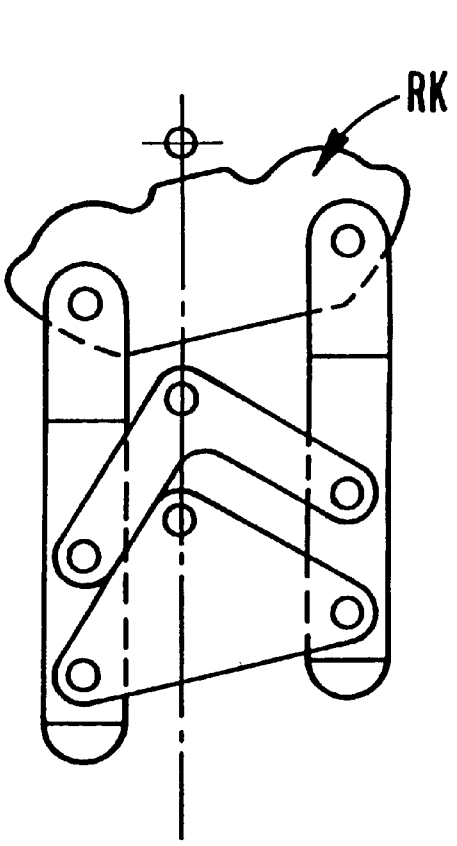
Figure 26B:
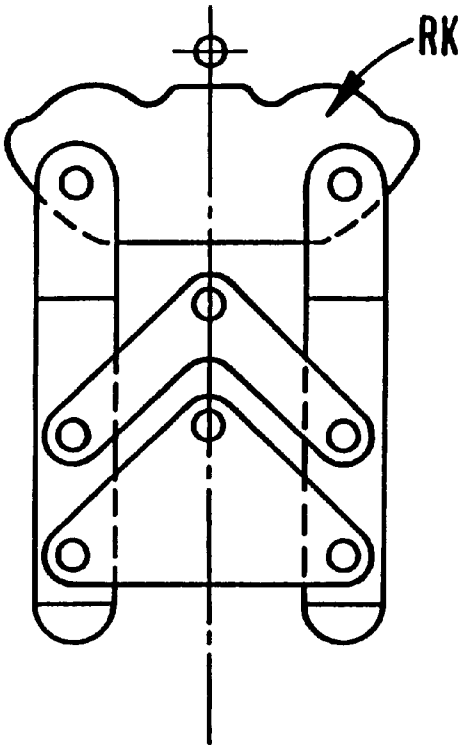
Figure 26A:
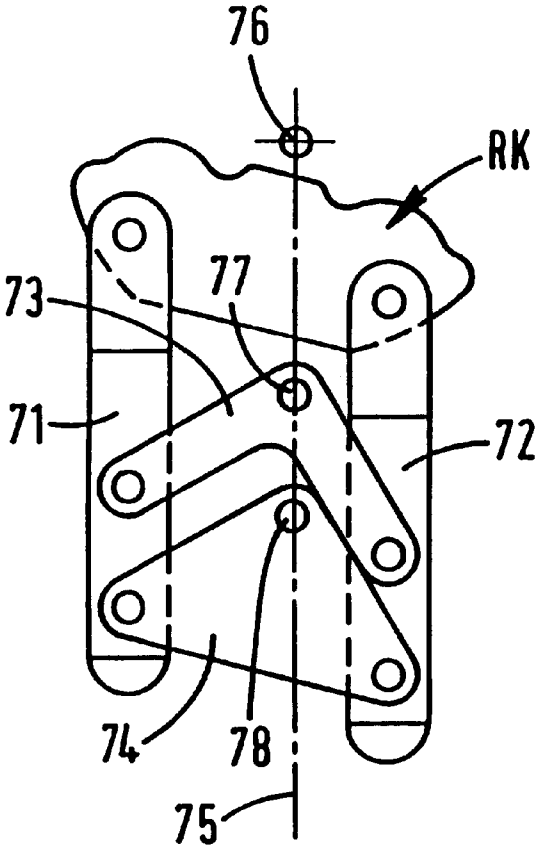
Figure 29:
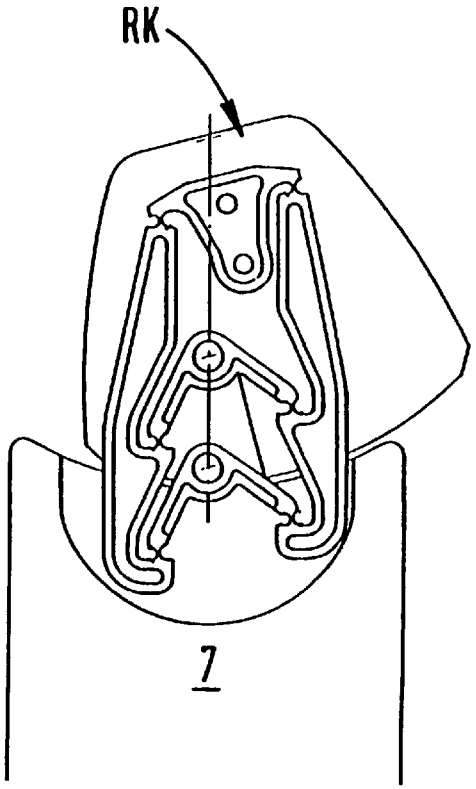
Figure 28:
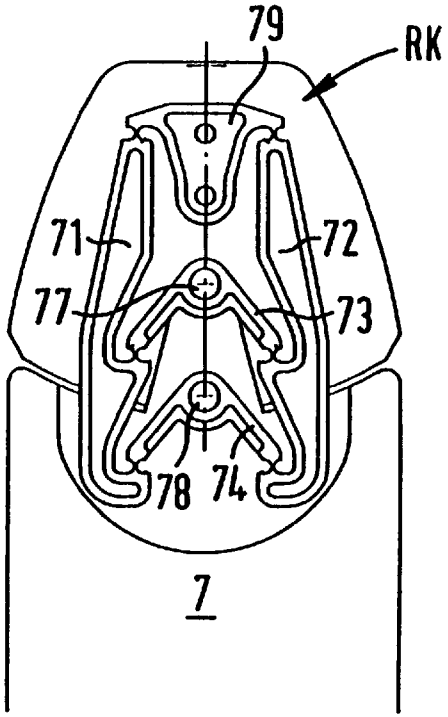
Figure 27:
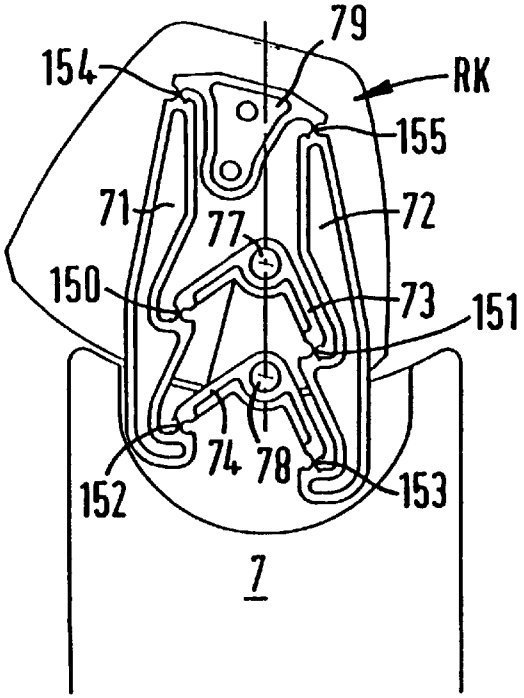
Figure 30:
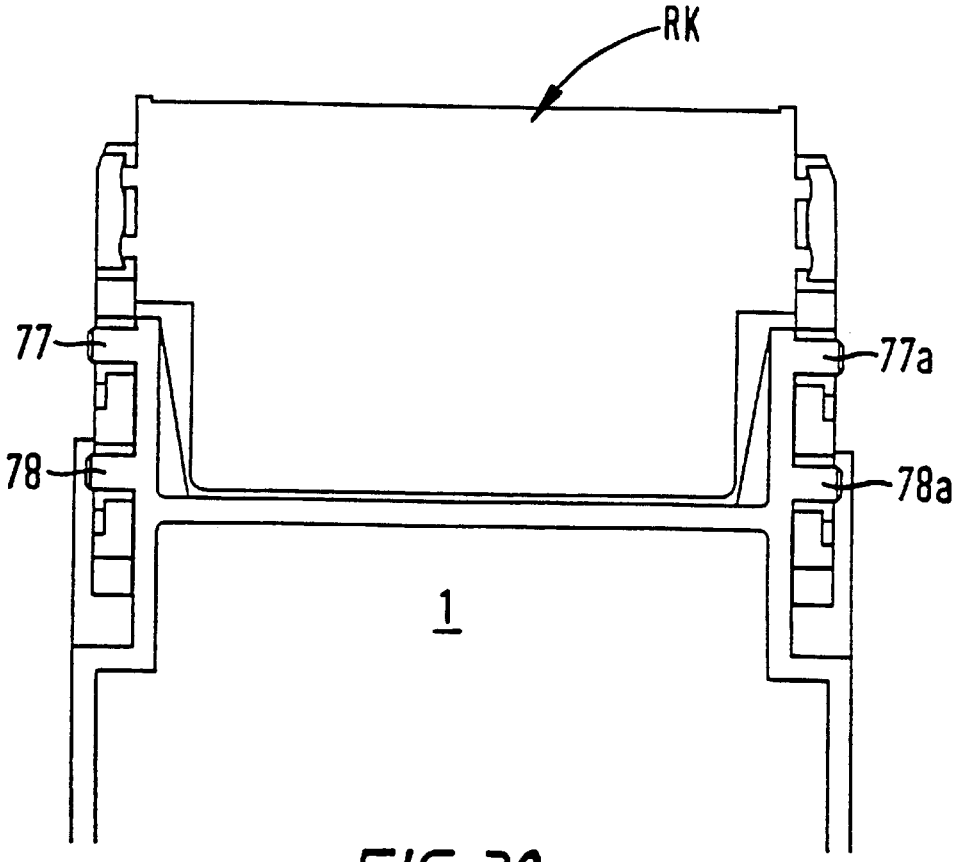
Figure 31:
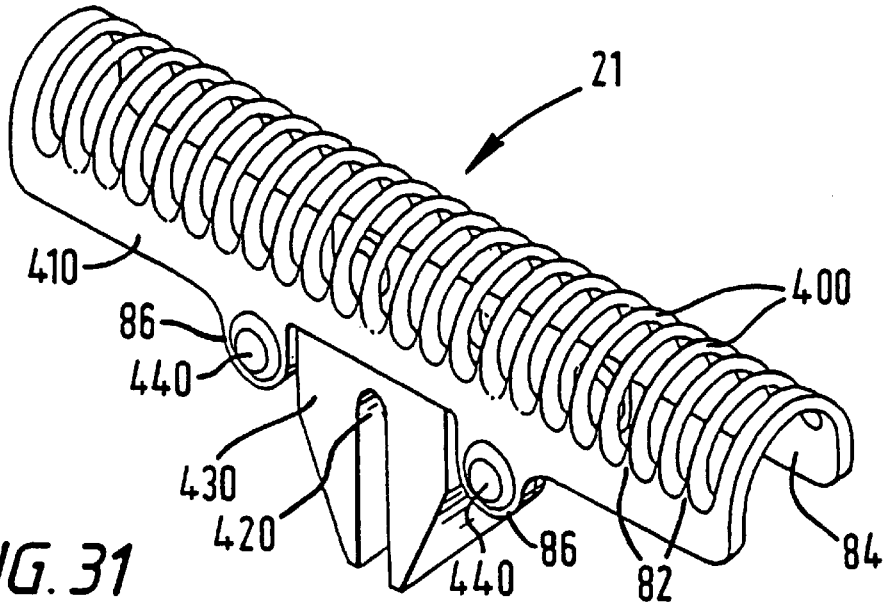

FIG. 3*a* is a longitudinal sectional view through the shaving head of the apparatus of FIG. 1 in a plane containing the line X—X in accordance with another embodiment of the invention;

FIG. 4 is a cross-sectional view corresponding to that of FIG. 2 of a second embodiment of shaving apparatus according to the invention;

FIG. 5 is a schematic end view of a dry shaver in accordance with another embodiment of the invention;

FIG. 6 shows the same view as FIG. 5, but with the having units displaced from their resting disposition, to a position in which one is above and the other is below the resting disposition;

FIG. 7 is a vertical section which included the longitudinal axis of one of the shaving foils of FIG. 5 with the inner cutter shown in a central position;

FIG. 8 is a vertical section corresponding to that of FIG. 7, but with the inner cutter shown in a displaced position;

FIG. 9*a* is a transverse cross-section corresponding to FIG. 5 showing more internal detail of the spring biasing system;

FIG. 9*b* is a transverse cross-section corresponding to FIG. 5 showing more internal detail of the drive mechanism of the shaving head;

FIG. 10 is an exploded view of a further embodiment of shaving apparatus according to the invention;

FIG. 11 is an exploded transverse sectional view of the apparatus of FIG. 10;

FIG. 12 is a transverse sectional view through the triple headed shaving apparatus or FIGS. 10 and 11;

FIG. 12*a* is an enlarged view of the inner and outer cutters shown in FIG. 12;

FIG. 13 is a transverse sectional view corresponding to FIG. 12 but with an alternative long hair cutter construction;

FIG. 13*a* is an enlarged view of the inner and outer cutters shown in FIG. 13;

FIG. 14 is a longitudinal sectional view through the long hair cutter of the embodiment of FIG. 10;

FIG. 14*a* is an enlarged view of the outer cutter shown in FIG. 14;

FIG. 15 is a longitudinal vertical section through one of the short hair cutters of the embodiment of FIG. 10;

FIG. 16 is an exploded perspective view of triple headed dry shaver apparatus according to another embodiment of the invention;

FIG. 16*a* is an exploded view of the inner cutter shown in FIG. 16;

FIG. 17 is an exploded transverse sectional view of the triple headed dry.,slaver apparatus of FIG. 16;

FIG. 18 is a transverse sectional view of the triple headed dry shaver apparatus of FIG. 16;

FIG. 18*a* shows an enlarged view of the long hair cutters shown in FIG. 18;

FIG. 19 is a transverse sectional view corresponding to FIG. 18 shoving of an alternative long hair cutter construction;

FIG. 19*a* is an enlarged view of the alternative long hair cutter construction shown in FIG. 19;

FIG. 20 is a longitudinal sectional view of the construction of short hair cutter in FIG. 18;

FIG. 21 is a longitudinal sectional view of a long hair cutter construction for the apparatus or FIG. 18;

FIG. 22 is a longitudinal sectional view of a further embodiment of long hair cutter for the apparatus of FIG. 19;

FIG. 23 is a transverse section of a further embodiment of the invention;

FIG. 24 is a perspective view of the upper part of the dry shaver apparatus, in the assembled condition according to the embodiment of FIG. 1, FIG. 10 or FIG. 16, with the rockable head in its central position;

FIG. 25 is a perspective view corresponding to FIG. 24, but with the rockable head in a tilted position;

FIG. 26, comprising individual FIGS. 26(*a*), 26(*b*) and 26(*c*), is a schematic diagram of a pivot mechanism for use in the embodiment of FIG. 23;

FIG. 27, FIG. 28 and FIG. 29 are side views of the construction of FIGS. 24 and 25 with one end plate removed to show the internal pivot mechanism in first, second and third positions;

FIG. 30 is a front elevation of the apparatus of FIGS. 27 to 29; and FIG. 31 is a perspective view of an example of undercutter suitable for use in the embodiments of FIGS. 1 to 30.

FIG. 1 shows the upper part of a dry-shaver having a housing 1, an on-off switch 2, a beard trimmer 3 having cutting teeth, an upper housing surface 4, a drive pin 6 protruding from an opening 5 in the upper housing surface 4, support arms 9 and 10 extending from respective narrow housing sides 7 and 8, and a shaving head RK mounted for rocking about an axis X—X by means of bearing pine 11 receivable in bearing holes 12 in the carrier arms 9 and 10.

In the shaver head RK, three mutually parallel shaving units 13, 14 and 15 are provided, or which the two outer shaving units 13 and 14 arc constructed as short hair cutters and the intermediate shaving unit 15 is constructed as a long hair cutter. The outer cutters 16 and 17 of the short hair cutter units 13, 14 are secured on a frame 19 which is removable from the shaving head frame 18. The outer cutter 20 of the shaving unit 15 is mounted for movement relative to the outer cutters 16 and 17 in the removable frame 19.

Further details of the shaving head RK are illustrated in FIGS. 2 and 3 and are described in more detail in the following. FIG. 2 chows a cross-section through the upper part of housing 1 and the rockable shaving head RK. Two inner cutters 21 and 22 of the short hair shaving units 13 and 14 contact respective outer cutters 16 and 17 mounted in arched form in the frame 19, the outer cutters 16 and 17 preferably being constructed ac shaving foils. The coupling element 23 consists of a base plate 24 with three integrally formed cup-shaped receptacles 25, 26 and 27 and cooperating cup-shaped covers 28, 29 and 30 as well as respective guide pins 42, 43 and 44 provided inside respective receptacles 25, 26, 27 and associated covers 28, 29 and 30, and including compression springs 31, 32, 33 surrounding respective pins. In order to ensure vertical guidance of the inner cutters 21, 22, 34, coupled to the respective covers 28, 29, 30, against the pressure of the respective springs 31, 32, 32, slide bores 35, 36, 37 are formed in the respective covers for receiving pins 42, 43 and 44 respectively. The inner cutters 21 and 22 are pivotably mounted on the upper ends of the receptacle covers 28, 29 by respective coupling elements 38, 39.

The coupling element 23 is coupled by means of the guide pin 44 with a drive element 40, consisting of an oscillating bridge—see FIG. 3. Facing the housing, the drive element 40 has a slot 41, in which engages the drive pin 6 to accommodate an oscillating movement and also a rocking movement of the head RK.

The shaving unit 15, constructed as a long hair cutter, and consisting of the outer cutter 20, the inner cutter 34, a spring 45 and a coupling element 46, is operatively coupled to the receptacle cover 30 and thus to the coupling element 23. Further details of the construction and arrangement of the shaving unit 15 are illustrated in FIG. 3 and will be described in more detail in the following, retaining the previously employed reference signs.

On the respective ends of the outer cutter 20, the cutter is provided with guide elements 47, 49, and Is movably mounted via these in guide grooves 51, 52 formed in the inner walls 49, 50 of the removable frame 19. On the guide elements 47, 48 are provided bearing arms 53, 54 which each form at least a partially L-shaped region extending towards the coupling element 46 as a counter-bearing for a spring 45, lying on the coupling element 46. The spring 45 is at least partially exposed in apertures 53A and 54A. The coupling element 46 and the spring 45 as well as the inner cutter 34 are rigidly connected together. As a consequence, the inner cutter 34 is pressed, by means of the spring 45 engaging with the bearing arms 53, 54, against the outer cutter 20. The spring 33 arranged in the coupling element 23 serves to accommodate the relative motion of the shaving unit 15 constructed as a long hair cutter, relative to the shaving units 13 and 14 constructed as snort hair cutters—sea FIG. 2—in response to a force externally applied to the shaving units. As a result of the relative motion or the shaving unit 15 relative to the shaving units 13, 14 good engagement of all shaving units with the skin is achieved, the previously usual actuation of the sharp-edged long hair cutter 3 required for trimming—see FIG. 1—being avoided for cutting long hairs in the course of shaving as a result of the differing construction of the shaving units as short hair cutter and long hair cutter.

The spring 33 provided for permitting the relative motion of the shaving unit 15 can according to a further embodiment—shown as springs 33*a* and 33*b* in FIG. 3*a*—be arranged to engage at both ends of the shaving head 15 between on the one hand a wall of the shaving head frame 18 and on the other hand the guide elements 47, 48.

FIG. 4 shows a further embodiment of a dry shaver having a long hair cutter 15 movable relative to the short hair cutter shaving units 13, 14. On the housing 1 is mounted a shaving head frame 60 which is removably connected to the housing 1. The drive pin 6 transmitting oscillatory motion is coupled via a guide pin 44 directly with the coupling element 23. The arrangement and construction of the inner cutters 21, 22 as well as the shaving unit 15 constructed as a long hair cutter on the coupling element 23 corresponds to the embodiment according to FIGS. 2 and 3.

The outer cutters 16 and 17 of the shaving units 13, 14 are secured on the shaving head frame 60. The long hair cutter shaving unit 15 corresponds in its construction to the embodiments illustrated in FIG. 3 and is coupled via the coupling element 46 to the spring assembly 30. Deviating from the embodiment according to FIG. 3, the respective ends of the shaving unit 15 are movably mounted by means of the guide elements 47, 48 in guide grooves—not illustrated—formed in the inner walls 49 of the shaving head frame 60.

Referring now to FIG. 5, a slaver head RK includes a first shaving unit 13 and a second shaving unit 14. Each of these units is supported at each end by a depending link, (part of the frame) and each or these four links is carried on an upper transverse rocker link 73 and a lower such link 74. In FIG. 5 the upper link 73 and lower link 74 are visible at one end of the head RK. Each of the rocker links is connected to respective shaving units 13 and 14 by a respective pair of living hinges 150, 151 or 152, 153. The housing body of the shaver provides pivot members 72, 78 on which the rocker links 73, 74 are pivotably mounted. This assembly allows the shaving unite to move up and down in response to externally applied force.

Turning now to FIG. 6, it is apparent that rotation of the rocker links 73, 74 causes some transverse displacement of the shaving units 13, 14, simultaneous with the rise and fall of the units 13, 14. This is of course because, for one of the two shaver units (in the case of FIG. 6, the right hand unit 14) the points of hinged attachment to the rocket links 73, 74 rotate to a position further away than the at-rest position from the plane P which includes the rotational axis of both of the links 73, 74. For the other shaving unit 13, of course, this same rotation of the rocker links 73, 74 brings the shaver head closer to the plane P through the rotational axes of the rocker link 73, 74.

Each shaving unit of FIGS. 5 and 6 comprises an inner cutter, an outer cutter (preferably a foil) and at least one spring element. FIGS. 7, 8, 9*a,* and 9*b* show how each inner cutter 21, 22 is mounted and driven. The inner cutter 21 is pressed against the inside of an arched shaving roil 16. The foil 16 is in fact carried on a structural element which includes a first end plate 210 and a second and plate 220 at opposite ends of the foil 16. The shaver head is completed by a common housing or shell which supports the pivotal movement of the four rocker links 131, 141 and also serves to attach the shaver head to the shaver body.

The cutter 21 is urged into contact with the surrounding foil by first and second spring biasing elements 230, 240. Each or these elements has a hollow cup base 250 and slightly larger domed cap 260 which is able to move telescopically up and down an the cup 250 guided by a pin 271. A helical spring 270 in the hollow interior or the element 230 urges the cup 250 and cap 260 apart. A detent 280 around the respective lips of the cup 230 and cap 260 prevents these two components from separating, whilst an eye 290 on the top of the cap 260 receives a pin 300 by which the biasing element 230 is connected at its upper end to the cutter 21. As best shown in FIG. 9*a* at the lower end 310 of each biasing element 230, 240 are provided two laterally projecting trunnion pins 311, 312 which rest on respective corresponding support surfaces 91, 92 cantilevered out from the adjacent free.

The cutter 21 has a multiplicity of parallel metal cutting blades 400. All of these blades extend outwardly from a backing portion 410 of the cutter. A slot 420 extends transversely to the length of the cutter 21 in a drive-receiving element 430 which is fastened to the backing portion 410 by a pair of rivets 440. A drive pin 6 which extends upwardly from the top of the shaver body (not shown) has an upper end 460 which is received within the slot 420, in order to impart oscillatory motion to cutter 21.

As the cutter 21 executes its oscillatory movement, each of the two biasing devices 230, 240 rocks on its pivot pin 300 and support surface 90, 91, with the spring 270 urging the cap 260 and cutter 21 upwardly, but even when the cutter is at the furthest extent of its lateral movement with the biasing devices 230, 240 fully inclined to the vertical at their maximum angle, as shown in FIG. 8, the detent surfaces 280 remain out or contact, so that the biasing force provided by the spring 270 is still effective.

It will be appreciated that the pin and transverse slot arrangement allows the cutter 21 to move transversely, as has been described above with reference to FIGS. 5 and 6, whether or not the drive pin 6 also moves sideways. In fact, there is no need for the drive pin 6 to have any capacity at all for sideways movement. Moreover, the pin 6 engages with slot 420 over sufficient length to prevent disengagement during the rocking movement of the shaving units described with reference to FIGS. 5 and 6.

Avoidance of any requirement for the drive pin 6 to move either sideways or up and down helps to simplify the construction of the drive train.

An important advantage of the cap and cup telescopic arrangement for the biasing elements 230, 240 is that their operation is less likely to be adversely affected by debris if the cap and cup are effective to prevent debris from fouling the turns of the spring 270 which provides the biasing force.

It can be seen from FIG. 7 how open the base of each shaver unit 11, 14 can be made. The cutter 21 itself is open over its base area, as is described in more detail hereinafter, particularly with reference to FIG. 31.

In FIG. 9*b,* the drive pin 6 has an upper and 460 which is bifurcated, to provide a first drive peg 500 which is received within a slot 420 of the shaving unit 13 and a second drive peg 520 which is received within a corresponding clot of the shaving unit 14. In FIG. 9*b,* the unit 14 is at its limit of upward movement, and so of course unit 13 is at the limit of its downward movement. In consequence, the peg 500 is at the top of the slot 420 and the peg 520 is near the lower open end of its slot. Furthermore, because shaving unit 13 is closer to the pivotal axis of the rocking links 73, 74 than when in its root position, and shaving unit 14 is further away than when in its rest position, the drive peg 500 goes through and beyond the slot 420, whereas the peg 520 does not extend all the way through the slot. This demonstrates how one drive bar 460 can accommodate all the vertical and horizontal movements of the units 13, 14 which occur in normal operation of the shaver.

FIG. 10 is an exploded view of a further embodiment of dry-shaving apparatus having three shaving units, including two short hair cutters 13 and 14 and a long hair cutter 15 positioned between the short hair cutters. The long hair cutter 15 is mounted for movement relative to short hair cutters 13 and 14 under forces applied during shaving.

In this embodiment, the outer cutter of the long hair cutter is in the form of a shaving foil 20 with transverse slots.

The under cutter 34 takes the form of a comb-like bar which oscillates longitudinally beneath the foil 20. The undercutters 21 and 22 for the short hair cutters take the form of arcuate slotted members of the form generally as shown in FIG. 31.

All three undercutters 21, 22 and 34 are mounted on a sub-assembly 40 acting as a drive element for the undercutters, i.e. acting to transit the drive from the base of the rockable shaving head RK to the undercutters.

The sub-assembly 40 consists of an upper cover member 30, which is rivetted to the central undercutter 34, a coupling element or fulcrum 301 on which the undercutter 34 pivots when assembled, a pressure spring 33 for biasing the undercutter against the outer foil 20 and a base plate 24 providing three cup-like receptacles 25, 26 and 27 carrying respective drive pine 42, 43 and 44. Coupling element 301 is slidably engaged with drive pin 44 and biased by the spring 33. Further springs 31 and 32 are provided in receptacles 25 and 26, as best shown in FIG. 11. Cover member 30 has two lateral apertures 302 which engage loosely over lateral lugs 303 on receptacle 27.

The lower end of pin 44 protrudes from the sub-assembly 40 and engages in and is returned by a hole 5 in the base surface or the rockable shaving head RK. The hole 5 is surrounded by an annular elastomeric seal member 5*a* to prevent the ingress of dust or shaving debris.

Referring to FIG. 11, which is a transverse exploded sectional view through the shaving head, it may be seen how the outer cup-like receptacles 25 and 26 are enclosed by respective covers 28 and 29, which also provide slide bores for receiving the drive pins 42 and 43.

FIG. 12 shows the components of FIG. 11 in an assembled condition. FIG. 12*a* shows an enlarged view of the form of outer cutter for the central long hair cutter 15.

FIGS. 13 and 13*a* are views similar to those of FIGS. 12 and 12*a* respectively, but with an alternative form or inner cutter for the central long hair cutter. In this embodiment, the inner cutter has a U-shaped cross-section and is similar to the undercutter described hereinafter with reference to FIGS. 16, 17 and 18.

FIG. 14 shows a longitudinal vertical section through the central long hair cutter 15 of FIG. 12. The Figure shows particularly the way in which the undercutter 34 to which the cap member 30 is riveted, rests on the coupling member 301 in a manner to permit rocking movement about a longitudinal or transverse axis. FIG. 14 also shows how he outer cutter 20 is mounted for vertical movement by means of a pin and slot arrangement 120 at each end to enable vertical floating motion of the central long hair cutter against the bias of the spring 33. The characteristics of spring 33 are set relative to those of springs 31 and 32 such that the vertical floating motion or the long hair cutter 15 will occur in use under the influence of normal shaving forces applied as the shaver glides over the skin.

Also note that FIG. 14*a* shows an enlarged view of the outer cutter 20.

FIG. 15 is a longitudinal vertical section through the short hair cutter 16 of FIG. 12. The undercutter 21 is pivotally secured to the cover member 28 which is interengaged with the cup member 25 forming a part of the base plate 24. The pin 42 is mounted in a bore in the member 25 and is able to slide in a slide bore in the, cover member 28, which can move against the bias of spring 31. The spring 31 thus functions to push the undercutter 21 into shaving contact with the outer foil 16.

FIG. 16 shows an isometric exploded view of a further embodiment of dry shaver apparatus according to the invention, in which a central long-hair cutter 15 is mounted for floating movement relative to two short hair cutters 13 and 14.

In this embodiment, the individual undercutters 21, 22 and 34 are individually mounted on respective spring assemblies and are separately driven by respective drive pins 6*a*, 6*b* and 6*c*. Drive pins 6*b* and 6*c* are integral parts or a drive member 6*b* through which the central drive pin 6*a* is inserted. The whole undercutter assembly is held together and retained in the outer cutter frame by a generally rectangular wire spring 90.

FIG. 16*a* shows the individual components supporting the undercutter 34 for the long hair trimmer 15. These components include a flat spring 341 and two inclined guide members 342 and 343 which are riveted to the undercutter 34. The characteristics of the flat spring 341 are adjusted to permit the floating movement during shaving.

Each of the undercutters 21 and 22 for the short hair cutters is supported on the respective spring assembly 40*a* or 40*b*. Reference to FIG. 17 shows the internal structure of the spring assemblies 40*a* and 40*b* in more detail. FIG. 17 also shows more clearly how the individual components are assembled together and held via the wire spring 90. The assembled position is shown in FIGS. 18 and 18*a*.

FIGS. 19 and 19*a* are views similar to those of FIGS. 18 and 18*a*, respectively, showing an alternative embodiment of undercutter for the central long hair trimmer 15. In this embodiment, the undercutter corresponds to the form of undercutter described and illustrated in the embodiment of FIG. 10.

FIG. 20 is a vertical sectional view through one of the short hair cutters of FIG. 18. FIG. 20 shows particularly clearly the construction of the spring assembly 40*a*, comprising a cover member 28*a*, a base member 25*a* and two internal springs 31*a* and 31*b* for providing a biasing force, biasing the undercutter 21 into shaving contact with the outer cutter 16.

FIG. 21 is a vertical sectional view through the long hair cutter 15 of FIG. 18. The Figure also shows how the drive pin 6*a* engages between the two guide members 342 and 343 and pushes against the flat spring 341. This provides the necessary biasing force pushing the undercutter 34 into shaving contact with the outer cutter 20.

FIG. 22 shows a vertical Sectional view through the long hair cutter 15 of the embodiment of FIG. 19. In this embodiment, the inner cutter 34 is in the form of a comb-like bar similar to the form of undercutter shown in FIG. 10. Again the drive pin 6*a* engages between two guide members 342 and 343 riveted to the undercutter 34. In this case however the biasing force is provided not by a flat spring, but rather by a spring wire 341*a*, which has its properties selected to permit the required floating movement during shaving.

FIG. 23 shows an embodiment of shaver having fixed geometry in which the shaving head RK rotates on the shaver body so through a conventional pivot (not shown) or using living hinges. By the expression "fixed geometry" is meant that the individual shaving units 13, 14 are intercoupled by being fixed relative to one another in the head RK. The head thus tilts as a whole. Lower curved surfaces 61 are shaped to clear counter surfaces 62 of the shaver body.

The first shaving unit 13 in the head RK has a shaving foil 16 in the form of a relatively shallot arch, and inside this arch is an inner cutter 21. Surfaces of the head RK support the long edges of the foil arch 16 and the lower ends of spring biasing means (not shown) which urge the inner cutter 21 up onto the inside of the arch of the foil 16.

The second shaving unit 14 in the head RK is identical to the first, and has a foil 17 and inner cutter 22. Between the first and second shaving units, and lying parallel to them is a long hair cutting unit 16 which also has a foil 20 and inner cutter 34, but the foil 20 has slots instead of small apertures, for improved catching of long hairs, for cutting by the inner cutter 34. As in other embodiments of the invention, the long hair gutter 15 is mounted for floating movement, against a spring, relative to short hair cutters 13 and 14.

To drive the first cutter 21, a transverse drive slot 62 is provided in a drive yoke 63 mounted mid-way along the length of the cutter 21, and a drive peg 64, upstanding from the body, engages with the slot 62. The flank pieces of the slot 62 are large enough always to flank the drive peg 64 irrespective of the rotational position of the head RK on the shaver body 7. The extreme positions of the drive peg 64 in the slot 62 can be seen in FIG. 23.

The second cutter 22 is driven by a second drive peg 65 in just the same way. The inner cutter 34 of the trimmer unit 15 is driven in a corresponding manner.

Referring now to FIG. 24, this shows a perspective view of the working end of dry shaving apparatus incorporating a rockable head RX having three shaving units 13, 14 and 15. In addition, a trimmer 3 is provided on the front surf ace of the body 1. FIG. 24 shows the rockable head RK in its central position. FIG. 25 corresponds to FIG. 24 but shows the rockable head RK in a fully tilted position.

Two variations of tiling mechanism by which the rocking action of the head RK is achieved in the embodiment of FIG. 24 and 25 are shown firstly in FIG. 26, and secondly in FIG. 27, 28 and 29. This tilting mechanism may also be employed in the embodiment of FIG. 23.

FIG. 26, comprising individual FIGS. 26(*a*), 26(*b*) and 26(*c*), may be regarded as a modification of the embodiment of FIG. 23 in the sense that in both FIG. 23 and in FIG. 26 the shaver head is of "fixed geometry" (although movable relative to the shaver body), in that the individual shaving units are fixed in position relative to the shaver head. Whilst in the embodiment of FIG. 23, the pivoting or rocking movement of the shaver head is achieved by means of a conventional pivot or living hinge, in the embodiment of FIG. 26 a parallelogram linkage is employed. In FIG. 26 the shaver head RK is mounted on upper ends of two pairs of vertical side members 71 and 72. (one pair of side members may be provided at each side of the shaver). At each side of the shaver the pair of vertical side members 71 and 72 constitute, in combination with transverse link members 73 and 74, a four bar mounting linkage. Each of links 73 and 74 constitutes a bell crank lever.

The bell crank levers 73 and 74 are pivoted at respective pivot points 77 and 78 to fixed points of the shaver frame (not shown). These fixed points of the shaver frame are located on a central plane 75 of the shaver. Through this construction a virtual pivot centre 76 is produced well above the points of attachment of the vertical side members 71 and 72 to the shaver head RK. In fact, the virtual pivot may be located on, above or below skin level in dependence upon the size of the pivoting triangles or bell crank links 73 and 74. This may be achieved without the need for a physical upper pivot location which a required in the embodiment of FIG. 23.

It will be understood that FIG. 26(*a*) shows the linkage pivoted towards the right-hand side, FIG. 26(*b*) shown the linkage in a central position, and FIG. 26(*c*) shows the linkage pivoted to the left.

In addition to this advantage of free location of the virtual pivot centre, this method of mounting the shaver head provides a single solidly linked foil frame assembly which is capable of supporting a multiplicity of foils, for example three foils as shown in FIG. 23, 24 or 25 or more. In addition, by use of the upper virtual pivot centre, the tendency of the individual foils to pivot during shaving, leading to shaving on the side of the foil, can be eliminated.

Referring now to FIGS. 27 to 29, an alternative form of parallelogram linkage is illustrated comprising vertical side member 71 and 72, and two rocking links 73 and 74, in the form of bell crank levers, pivoted on the body at pivot point 77 and 78. Contrary to the method employed in FIG. 26, here the upper ends of the arms 71 and 72 are secured to a link member 79 which in turn is secured to the side of the rocking head RK. Moreover, all pivot points of the mechanism are achieved by means of living hinges 150 to 155 in a similar manner to that illustrated in FIGS. 5 and 6. Clearly FIG. 27 and 29 snow the mechanism in the two extremes of the tilting action, whereas FIG. 28 shows the mechanism in its central position.

FIG. 30 shows the apparatus of FIGS. 27–29 in a front elevation. The form of the pivot points 77 and 78 is shown more clearly in this Figure. The Figure also demonstrates that corresponding pivot points 77*a* and 78*a* are provided on the other side of the apparatus, together with a corresponding tilting mechanism. FIG. 28 may be regarded as an end view of the apparatus of FIG. 30.

Referring to FIG. 31, an inner cutter 21 has a multiplicity of arcuate bridge cutter elements 400, which define a part cylindrical cutting surface for cooperation with a cutting foil of the shaver on the outwardly convex outer surface or ate bridge elements. In fact, the arc of the bridge elements in part-circular, so that the cutter is entirely open from below, to provide a high degree of debris transparency.

All the first ends 82 of the bridge elements 400 are linked together by a first support beam 410 which extends the length of the cutter. A similar support beam 84 links together all the second ends of the bridge elements 400, so that the first and second beams race each other from opposite sides of the bridge of the cutter.

Half-way along the length of each of the beams 410, 84 is mounted a yoke 430 of plastics material, mounted by means of two small plastics rivets 440 which extend through bores in the yoke 430 and through fins 86 which extend for a short distance downwardly from the remainder of the beam 410. Each yoke 430 defines a slot 420 for accommodating the transverse pin of a drive peg.

It is preferred to begin the manufacture of the arched cutters with a flat piece of metal. In one possible manufacturing process, the first step is to press a flat work piece of hardenable steel into the required arcuate shape, and then to form the cutter elements by transverse slitting, by grinding or cutting. The requisite heat treatment process is performed before or after the slitting process, but preferably before.

Thus, following pressing of the metal work piece into an arcuate member, a heat treatment process is performed to harden the steel. Transverse slots are then formed, and the resulting article is ground, using longitudinal profile grinding, to give the required final dimensions.

What is claimed is:

1. Dry shaving apparatus comprising:

shaver housing having a head frame which carries three elongated cutter heads each having a longitudinal axis, said three elongated cutter heads composed of a center cutter head and two outer cutter heads arranged on opposite sides of said center cutter head with the individual longitudinal axes substantially parallel to each other, each of said two outer cutter heads comprising an outer foil and an outer movable cutter driven to reciprocate along said longitudinal axis of each of said two outer cuter heads in hair shearing engagement with said outer foil of each of said two outer cutter heads, said center head comprising a stationary cutter and a center movable cutter driven to reciprocate along said longitudinal axis of said center cutter head in hair shearing engagement with said stationary cutter of said center cutter head;

reciprocating means for imparting a reciprocating motion to said three elongated cutter heads;

wherein said stationary cutter of said center cutter head is of a generally U-shaped configuration with a top wall and a pair of side walls depending from opposed lateral sides of said top wall;

said top wall being formed with a plurality of slits which are spaced along the longitudinal axis of said center cutter head and are opened into said opposed side walls, said center movable cutter being disposed in shearing engagement with a lower surface of said top wall between said side walls of said stationary cutter and being provided at a longitudinal center of said center movable cutter with a coupler which projects between said side walls for coupling with said reciprocating means;

said stationary cutter being secured at its longitudinal ends respectively to holders each comprising at least a partially L-shaped region disposed between said opposed side walls, said holders formed respectively with connections for connection with said head frame;

at least one spring being held between said holders and center movable cutter for biasing said center movable cutter against said stationary cutter; and said opposed side walls being formed at least partially with an aperture through which said at least one spring is at least partially exposed.

2. Dry shaving apparatus comprising a shaver housing having a shaver head which has two outer elongate cutter heads and a central elongate cutter head, each with substantially mutually parallel longitudinal axes, the two outer cutter heads each having a respective under cutter for reciprocation in the direction of its longitudinal axis in shaving engagement with an upper cutter and the central cutter head having an under cutter driven for reciprocation in the direction of its longitudinal axis in shaving engagement with a stationary upper cutter, the stationary upper cutter of the central cutter head being substantially U-shaped with an upper wall and two opposed side walls extending downwardly therefrom, the upper wall being provided with a plurality of slots which extend into the side walls and are spaced along the longitudinal axis of the central cutter head, the central movable under cutter being arranged between the opposed side walls in shaving engagement with the lower side of the upper wall of the stationary upper cutter and having on its longitudinal center a coupling element for coupling to an oscillating element, the stationary upper cutter being secured at its longitudinal ends to respective bearing arms which are arranged between the opposed side walls and are each provided with guide elements for connection to a shaving head frame, and a spring arrangement being provided between the bearing arms and the central movable under cutter in order to bias the under cutter of the central cutter head against the stationary upper cutter, wherein each of the two outer and the central cutter heads has at least one biasing element and the biasing element of one of the cutter heads has a characteristic which differs from that of the biasing element of another of the cutter heads which characteristic is such that under the effect of a force applied externally to the cutter heads, motion can be performed by one of the cutter heads relative to another of the cutter heads.

3. Dry shaving apparatus comprising:

a shaver housing with three elongated cutter heads each having a longitudinal axis, said three elongated cutter heads composed of a center cutter head and two outer cutter heads arranged on opposite sides of said center cutter head with the individual longitudinal axes of said three elongated cutter heads lying substantially parallel to each other, each of said two outer cutter heads comprising an outer foil and an outer movable cutter driven to reciprocate along said longitudinal axis of each of said two outer cutter heads in hair shearing engagement with said outer foil of each of said two outer cutter heads, said center cutter head comprising a stationary cutter and a center movable cutter driven to reciprocate along said longitudinal axis in hair shearing engagement with said stationary cutter of said center cutter head;

reciprocating means for imparting a reciprocating motion to said outer and center movable cutters;

said stationary cutter of said center cutter head being of a generally U-shaped configuration with a slotted top wall and a pair of side walls depending from opposed lateral sides of said top wall, said stationary cutter having longitudinal ends secured respectively to holders each comprising at least a partially L-shaped region disposed between said side walls, said holders supporting at least one spring being held between said holders and center movable cutter for biasing said center movable cutter against said stationary cutter;

said center movable cutter of said center cutter head being provided with a downwardly extending coupler for connection with said reciprocating means; and wherein said coupler of said center movable cutter is connected with said reciprocating means at a coupling point which is spaced away from lower edges of said side walls of said stationary cutter.

4. Dry shaving apparatus as set forth in claim 3 wherein said coupling point is within a reciprocating length of said coupler.

5. Dry shaving apparatus as set forth in claim 3 wherein said coupling point is between said holders.

6. Dry shaving apparatus as set forth in claim 3 wherein said shaver housing further comprises a head frame and said center cutter head is floatingly supported by opposed longitudinal end walls of said head frame.

7. Dry shaving apparatus as set forth in claim 6 wherein each of said holders is formed for connection with said head frame.

8. Dry shaving apparatus comprising a shaver housing having a shaver head which has two outer elongate cutter heads and a central elongate cutter head, each with substantially mutually parallel longitudinal axes, the two outer cutter heads each having a respective under cutter for reciprocation in the direction of its longitudinal axis in shaving engagement with an upper cutter and the central cutter head having an under cutter driven for reciprocation in the direction of its longitudinal axis in shaving engagement with a stationary upper cutter, the stationary upper cutter of the central cutter head being substantially U-shaped with an upper wall and two opposed side walls extending downwardly therefrom, the upper wall being provided with a plurality of slots which extend into the side walls and are spaced along the longitudinal axis of the central cutter head, the central movable under cutter being arranged between the opposed side walls in shaving engagement with the lower side of the upper wall of the stationary upper cutter and having on its longitudinal center a coupling element for coupling to an oscillating element, the stationary upper cutter being secured at its longitudinal ends to respective bearing arms which are arranged between the opposed side walls and are each provided with guide elements for connection to a shaving head frame, and a spring arrangement being provided between the bearing arms and the central movable under cutter in order to bias the under cutter of the central cutter head against the stationary upper cutter, wherein each of the two outer cutter heads and the central cutter head are movably mounted in the shaving head frame against the bias of a respective spring element, the spring element of the central cutter head having a characteristic which differs from that of the spring elements of the two outer cutter heads, in such manner that during shaving and under the effect of equal forces the central cutter head retreats against its respective spring element relative to the outer cutter heads.

9. Dry shaving apparatus according to claim 8 wherein the spring elements for providing a relative movement are provided on the one hand on the shaving head frame and on the other hand on the central cutter head and are separate from the spring arrangement provided for biasing the central under cutter onto the stationary upper cutter of the central cutter head.

10. Dry shaving apparatus according to claim 9 herein the under cutter of the central cutter head is substantially U-shaped.

11. Dry shaving apparatus comprising a shaver housing having a shaver head which has two outer elongate cutter heads and a central elongate cutter head, each with substantially mutually parallel longitudinal axes, the two outer cutter heads each having a respective under cutter for reciprocation in the direction of its longitudinal axis in shaving engagement with an upper cutter and the central cutter head having an under cutter driven for reciprocation in the direction of its longitudinal axis in shaving engagement with a stationary upper cutter, the stationary upper cutter of the central cutter head being substantially U-shaped with an upper wall and two opposed side walls extending downwardly therefrom, the upper wall being provided with a plurality of slots which extend into the side walls and are spaced along the longitudinal axis of the central cutter head, the central movable under cutter being arranged between the opposed side walls in shaving engagement with the lower side of the upper wall of the stationary upper cutter and having on its longitudinal center a coupling element for coupling to an oscillating element, the stationary upper cutter being secured at its longitudinal ends to respective bearing arms which are arranged between the opposed side walls and are each provided with guide elements for connection to a shaving head frame, and a spring arrangement being formed from a spring supported on the bearing arms and provided between the bearing arms and the central movable under cutter in order to bias the under cutter of the central cutter head against the stationary upper cutter.

12. Dry shaving apparatus according to claim 11 wherein the central cutter head is movably mounted by means of the guide elements in the shaving head frame.

13. Dry shaving apparatus according to claim 11 herein the bearing arms are constructed as counter-bearings for the spring arrangement acting on the under cutter of the central cutter head.

14. Dry shaving apparatus according to claim 13 herein the central cutter head arranged in said shaving head frame by means of the guide elements is movably mounted against the bias of at least one spring element.

15. Dry shaving apparatus according to claim 11 wherein the spring arrangement is coupled to the coupling element.

16. Dry shaving apparatus according to claim 15 herein the coupling element is coupled to the under cutter of the central cutter head.

17. Dry shaving apparatus according to claim 11 wherein the upper cutter of each respective one of the two outer heads is constituted by a shaving foil.

18. Dry shaving apparatus according to claim 11 wherein each under cutter and associated spring arrangement is mounted within the associated cutter head to be removable as a part of the cutter head.

19. Dry shaving apparatus according to claim 11 wherein each of said bearing arms comprises at least a partially L-shaped region.

20. Dry shaving apparatus according to claim 11 wherein said opposed side walls are formed at least partially with an aperture through which said spring arrangement is at least partially exposed.

21. Dry shaving apparatus according to claim 11 wherein each of said bearing arms comprises at least a partially L-shaped region and said opposed side walls are formed at least partially with an aperture through which said spring arrangement is at least partially exposed.

* * * * *

UNITED STATES PATENT AND TRADEMARK OFFICE

CERTIFICATE OF CORRECTION

PATENT NO : 6,098,289

DATED : August 8, 2000

INVENTOR : Matthias Wetzel et al.

It is certified that error appears in the above-identified patent and that said Letters Patent are hereby corrected as shown below:

[62] Change "as application No. PCT/EP92/02960, Dec. 18, 1992, Pat. No. 5,611,145." to --Nov. 7, 1994, now U.S. Pat. No. 5,611,145, which is a 371 of PCT/EP92/02960, filed Dec. 18,1992.--;

Column 1, line 8, Change "unite" to --units-- and change "or" to --of--;
Column 1, line 41, Change "or" to --of--;
Column 1, line 45, Change "having" to --shaving--;
Column 1, line 46, Change "or" to --of--;
Column 1, line 49, Change "be-performed" to --be performed--;
Column 1, line 59, Change "unite" to --units--;
Column 1, line 62, Change "roil" to --foil--;
Column 2, line 11, Change "In" to --in--;
Column 2, line 16, Change "or" to --of--;
Column 2, line 24, Change "accompany" to --accompanying--;
Column 2, line 44, Change "having" to --shaving--;
Column 2, line 47, Change "included" to --includes--;
Column 2, line 63, Change "or" to --of--;

UNITED STATES PATENT AND TRADEMARK OFFICE

CERTIFICATE OF CORRECTION

PATENT NO : 6,098,289

DATED : August 8, 2000

INVENTOR : Matthias Wetzel, et al.

It is certified that error appears in the above-identified patent and that said Letters Patent are hereby corrected as shown below:

| | |
|---|---|
| Column 3, line 14, | Change "dry., slaver" to --dry shaver-- |
| Column 3, line 20, | Change "shoving" to --showing-- and delete "of"; |
| Column 3, line 27, | Change "or" to --of--; |
| Column 3, line 58, | Change "or" to --of--; |
| Column 3, line 59, | Change "arc" to --are--; |
| Column 4, line 5, | Change "ac" to --as--; |
| Column 4, line 35, | Change "49," to --48,-- and change "Is" to --is--; |
| Column 4, line 50, | Change "snort" to --short--; |
| Column 4, line 52, | Change "or" to --of--; |
| Column 4, line 62, | Before "shown" insert --as--; |
| Column 5, line 1[illegible] | Change "slaver" to --shaver--; |
| Column 5, line 22, | Change "or" to --of--; |
| Column 5, line 28, | Change "72," to --77,--; |
| Column 5, line 30, | Change "unite" to --units--; |
| Column 5, line 37, | Change "rocket" to --rocker--; |
| Column 5, line 43, | Change "link" to --links--; |
| Column 5, line 48, | Change "roil" to --foil--; |
| Column 5, line 50, | Change "second and" to --second end--; |
| Column 5, line 57, | Change " or" to --of--; |
| Column 5, line 59, | Change "an" to --on--; |
| Column 5, line 60, | Change "or" to --of--; |
| Column 6, line 3, | Change "free." to --frame.--; |
| Column 6, line 20, | Change "or" to --of--; |
| Column 6, line 40, | Change "11," to --13,--; |
| Column 6, line 43, | Change "and" to --end--; |
| Column 6, line 47, | Change "clot" to --slot--; |
| Column 6, line 56, | Change "the" to --its--; |

UNITED STATES PATENT AND TRADEMARK OFFICE

CERTIFICATE OF CORRECTION

PATENT NO : 6,098,289

DATED : August 8, 2000

INVENTOR : Matthias Wetzel et al.

It is certified that error appears in the above-identified patent and that said Letters Patent are hereby corrected as shown below:

Column 7, line 8, Change "transit" to --transmit--;
Column 7, line 16, Change "pine" to --pins--;
Column 7, line 36, Change "or" to --of--;
Column 7, line 46, Change "he" to --the--;
Column 7, line 52, Change "or" to --of--;
Column 7, line 62, Change "the," to --the--;
Column 8, line 6, Change "or" to --of--;
Column 8, line 43, Change "Sectional" to --sectinal--;
Column 8, line 55, Change "so" to --50--;
Column 8, line 63, Change "shallot" to --shallow--;
Column 9, line 8, Change "gutter" to --cutter--;
Column 9, line 23, Change "RX" to --RK--;
Column 9, line 24, Change "srf ace" to --surface;
Column 9, line 28, Change "tiling" to --tilting--;
Column 9, line 44, Change "(one" to --(One--;
Column 9, line 60, Change "a" to --is--;
Column 9, line 63, Change "shown" to --shows--;
Column 10, line 17, Change "snow" to --show--;
Column 10, line 30, Change "or ate" to --of the--;
Column 10, line 31, Change "elements in" to --elements is--;

UNITED STATES PATENT AND TRADEMARK OFFICE

CERTIFICATE OF CORRECTION

PATENT NO. : 6,098,289

DATED : August 8, 2000

INVENTOR(S) : Matthias Wetzel et al.

It is certified that error appears in the above-identified patent and that said Letters Patent is hereby corrected as shown below:

Column 10, line 38, Change "race" to --face--;
Column 11, line 3, Change "cuter" to --cutter--;
Column 13, line 31, Change "herein" to --wherein--;
Column 14, line 16, Change "herein" to --wherein--;
Column 14, line 20, Change "herein" to --wherein--;
Column 14, line 26, Change "herein" to --wherein--;

Signed and Sealed this

Eighth Day of May, 2001

*Attest:*

Nicholas P. Godici

NICHOLAS P. GODICI

*Attesting Officer*

*Acting Director of the United States Patent and Trademark Office*